US011110469B2

(12) United States Patent
Kwasniewicz

(10) Patent No.: US 11,110,469 B2
(45) Date of Patent: Sep. 7, 2021

(54) MAGNETIC SEPARATOR APPARATUS AND METHODS OF FABRICATING, DISASSEMBLING, CLEANING, AND REASSEMBLING SAME

(71) Applicant: MAGNETIC PRODUCTS, INC., Highland, MI (US)

(72) Inventor: Ronald Kwasniewicz, Walled Lake, MI (US)

(73) Assignee: Magnetic Products, Inc., Highland, MI (US)

( * ) Notice: Subject to any disclaimer, the term of this patent is extended or adjusted under 35 U.S.C. 154(b) by 406 days.

(21) Appl. No.: 16/164,126

(22) Filed: Oct. 18, 2018

(65) Prior Publication Data

US 2019/0046993 A1 Feb. 14, 2019

Related U.S. Application Data

(63) Continuation-in-part of application No. 15/689,025, filed on Aug. 29, 2017, now Pat. No. 10,300,497.

(60) Provisional application No. 62/574,383, filed on Oct. 19, 2017, provisional application No. 62/381,342, filed on Aug. 30, 2016.

(51) Int. Cl.

| | |
|---|---|
| ***B03C 1/28*** | (2006.01) |
| ***B03C 1/03*** | (2006.01) |
| ***B03C 1/033*** | (2006.01) |
| ***B03C 1/06*** | (2006.01) |

(Continued)

(52) U.S. Cl.

CPC ..... *B03C 1/03* (2013.01); *B03C 1/0332* (2013.01); *B03C 1/06* (2013.01); *B03C 1/26* (2013.01); *B03C 1/284* (2013.01); *B03C 1/286* (2013.01); *B03C 1/247* (2013.01); *B03C 1/288* (2013.01); *B03C 2201/18* (2013.01); *B03C 2201/20* (2013.01); *B03C 2201/26* (2013.01); *B03C 2201/28* (2013.01)

(58) Field of Classification Search

CPC ..... B03C 1/0332; B03C 1/04; B03C 1/06; B03C 1/26; B03C 1/284; B03C 1/286; B03C 1/288; B03C 2201/20; B03C 1/28; B03C 1/03

USPC ..... 209/228, 229, 230

See application file for complete search history.

(56) References Cited

U.S. PATENT DOCUMENTS

| | | |
|---|---|---|
| 4,457,838 A | 7/1984 | Carr |
| 4,867,869 A | 9/1989 | Barrett |

(Continued)

*Primary Examiner* — Joseph C Rodriguez

(74) *Attorney, Agent, or Firm* — Fishman Stewart PLLC

(57) ABSTRACT

A magnetic separator includes a housing defining a product flow path, a drawer moveable between a first position and a second position, a magnet operatively connected to the drawer, the magnet positioned within the product flow path when in the first position and the magnet withdrawn from the flow path when in the second position, and a stripper plate frame attached to the housing. A stripper plate is fixed to the stripper plate frame that conforms with the magnet and through which the magnet passes as the drawer is moved between the first and second positions. An anti-rotation mechanism includes a slot that engages along a length of a shoulder such that. When the anti-rotation mechanism is positioned having the slot over the shoulder, the magnet is prevented from moving from the axially locked position. The shoulder extends beyond an outer surface of the anti-rotation mechanism.

14 Claims, 15 Drawing Sheets

(51) Int. Cl.
*B03C 1/26* (2006.01)
*B03C 1/247* (2006.01)

(56) References Cited

U.S. PATENT DOCUMENTS

| | | | | | |
|---|---|---|---|---|---|
| 5,043,063 | A * | 8/1991 | Latimer | B03C 1/288 | 210/222 |
| 5,066,390 | A * | 11/1991 | Rhodes | B03C 1/284 | 209/217 |
| 5,188,239 | A | 2/1993 | Stowe | | |
| 5,190,159 | A | 3/1993 | Barker | | |
| 5,316,151 | A | 5/1994 | Thompson | | |
| 6,077,333 | A * | 6/2000 | Wolfs | B03C 1/0332 | 96/1 |
| 6,250,475 | B1 | 6/2001 | Kwasniewicz et al. | | |
| 6,902,066 | B2 | 6/2005 | Yang | | |
| 8,360,247 | B2 | 1/2013 | Baker | | |
| 8,474,629 | B1 | 7/2013 | Allore et al. | | |
| 8,544,654 | B2 | 10/2013 | Williams et al. | | |
| 8,641,899 | B2 * | 2/2014 | Branch | B03C 1/032 | 210/222 |
| 9,242,249 | B2 | 1/2016 | Baker | | |
| 10,300,497 | B2 * | 5/2019 | Kwasniewicz | B03C 1/03 | |
| 10,807,101 | B2 * | 10/2020 | Pallin | B03C 1/286 | |
| 2018/0078947 | A1 * | 3/2018 | Pallin | B03C 1/284 | |

* cited by examiner

MAGNETIC SEPARATOR APPARATUS AND METHODS OF FABRICATING, DISASSEMBLING, CLEANING, AND REASSEMBLING SAME

CROSS-REFERENCE TO RELATED APPLICATIONS

This application is a continuation-in-part of U.S. patent application Ser. No. 15/689,025, filed Aug. 29, 2017, which claims priority to U.S. Provisional Patent Application Ser. No. 62/381,342, filed Aug. 30, 2016, and which have been incorporated by reference in their entirety, and this application also claims priority to U.S. Provisional Patent Application Ser. No. 62/574,383, filed Oct. 19, 2017, which is incorporated by reference in its entirety.

BACKGROUND

1. Technical Field

The present disclosure relates to magnetic separators employed for removing ferrous materials from a product stream. More specifically, the present disclosure is directed toward magnetic separators having improved ferrous material removal, as well as improved hygienic and compliant assembly of the magnetic separator.

2. Description of the Related Art

Magnetic separators are employed in many food processing operations and are even mandatorily required in some. They are also used in the manufacture of pharmaceuticals, in the chemical industry where process lines are alternatingly used for two or more incompatible products and wherever the highest degree of product purity is required. These devices often include a housing defining a hopper through which a number of non-magnetic tubes are mounted transverse to the product flow through the hopper. A plurality of magnets includes several magnets that are located within the non-magnetic tubes. As the product flows past the tubes, ferrous particles are collected on the outer diameters thereof.

While these magnetic separators known in the related art have generally performed well for their intended purpose, there remains a need in the art for an improved magnetic separator.

SUMMARY

The present disclosure overcomes the disadvantages in the related art in a magnetic separator including a housing which defines a product flow path through which material may pass. The magnetic separator further includes a drawer moveable between a first position and a second position and at least one magnet operatively connected to the drawer. The at least one magnet is positioned within the product flow path in the first position of the drawer and with the at least one magnet withdrawn from the flow path when in the second position.

The magnetic separator further includes a stripper plate fixed to the housing and disposed between the housing and the drawer. The stripper plate has at least one aperture corresponding to and closely conforming with the at least one magnet and through which the at least one magnet passes as the drawer is moved between the first and second positions. The stripper plate is spaced a predetermined distance from the housing to define a gap therebetween, with the at least one aperture of the stripper plate serving to strip material which has been attracted to the at least one magnet and off of the at least one magnet in the gap as the drawer is moved from the first position to the second position and the at least one magnet is withdrawn from the product flow path.

In this way, the present disclosure provides the advantage of the stripper plate being permanently spaced from the housing, preventing the stripper plate from sticking to the housing and thereby resulting in captured magnetic material being stripped off the at least one magnet and back into the product flow path. Moreover, the present disclosure allows for removal of the stripper plate, without the need of a tool, to allow for easy cleaning of the stripper plate. Moreover, the stripper plate is coupled to the housing without fasteners, which may be unsanitary, thereby improving the sanitary condition of the magnetic separator. Further, according to the disclosure, a locking fastener attached to a shoulder of each magnet prevents the magnet from passing through a keyed opening, which may result from an unintended rotation of the magnet during maintenance of the magnetic separator, such as during stripper plate maintenance or cleaning.

The present disclosure also provides for the magnetic separator including the housing defining the product flow path through which the material may pass. The housing has a pair of diverters opposing one another and extending into the product flow path.

The magnetic separator includes the drawer moveable between the first position and the second position and the at least one magnet operatively connected to the drawer, with the at least one magnet positioned within the product flow path in the first position of the drawer and with the at least one magnet withdrawn from the flow path when in the second position.

The magnetic separator includes a tube support disposed within the product flow path. The at least one magnet is operatively connected to the tube support. The tube support has a pair of slots corresponding to and adapted to receive the pair of diverters therein such that the pair of diverters guide the movement of the tube support, the at least one magnet, and the drawer between the first and second positions.

In this way, the present disclosure provides the advantage of the tube support utilizing the pair of diverters of the housing to support the tube support, which eliminates the need of a separate rail system to support the tube support. Moreover, the eliminating the need for a separate rail system reduces the number of components within the product flow path, each of which could be unsanitary, and thereby improves the overall sanitation of the magnetic separator.

The present disclosure also provides for the magnetic separator including the housing defining the product flow path through which the material may pass and the drawer moveable between the first position and the second position. The magnetic separator further includes the tube support disposed within the product flow path and the at least one magnet. The at least one magnet extends between a pair of ends. The at least one magnet may be operatively connected to each of the drawer and the tube support, with the at least one magnet positioned within the product flow path in the first position of the drawer and with the at least one magnet withdrawn from the flow path when in the second position.

The magnetic separator includes a locking mechanism extending from at least one of the pair of ends. At least one of the drawer and the tube support defines at least one keyed opening corresponding to and adapted to accept the locking mechanism of the at least one magnet. The locking mechanism is rotatable between an unlocked position, in which the locking mechanism may freely move into and out of the keyed opening, and a locked position, in which the locking mechanism is retained in the keyed opening. Further, the locking mechanism includes a fastener attached to a shoulder of each magnet that prevents the magnet from passing through the keyed opening, which may result from an unintended rotation of the magnet during maintenance of the magnetic separator, such as during stripper plate maintenance or cleaning.

In this way, the present disclosure provides the advantage of the at least one magnet being coupled to the drawer and/or the tube support without the need of fasteners Eliminating fasteners improves the sanitation of the magnetic separator and prevents fasteners from inadvertently being lost or placed into the product flow path. Furthermore, the elimination of fasteners improves the ease with which the at least one magnet may be assembled with the drawer and/or the tube support.

The present disclosure also provides for the magnetic separator including the housing defining the product flow path through which the material may pass and the drawer moveable between the first position, the second position, and a third position. The magnetic separator includes the at least one magnet operatively connected to the drawer, with the at least one magnet positioned within the product flow path in the first position of the drawer and with the at least one magnet withdrawn from the flow path when in the second position.

The magnetic separator further includes at least one guide rail fixed to the drawer and movably coupled to the housing to support the drawer relative to the housing, and a second position stop selectively mounted to the at least one guide rail and engageable with the housing. The second position stop limits movement of the drawer between the first and second positions when mounted to the at least one guide rail. The drawer is movable between the first, second, and third positions when the second position stop is disconnected from the at least one guide rail.

In this way, the present disclosure provides the advantage of the second position stop selectively being mounted to the at least one guide rail, thereby allowing selective movement to the third position. Movement of the drawer to the third position is desired for maintenance, but may not be desired for standard operation of the drawer. Therefore, the second position stop allows for ease of retaining drawer within the first and second positions, while allowing the drawer to move to the third position when needed for maintenance. That is, when moved to the third position, the at least one magnet may be disconnected from the tube support in order to pass the at least one magnet to a retention plate, which supports each of the at least one magnets at a location that frees each of the stripper plates so that they may be removed from their respective notches in which the stripper plates are mounted. However, a locking mechanism includes a fastener attached to a shoulder of each magnet that prevents the magnet from passing through the keyed opening, which may result from an unintended rotation of the magnet during maintenance of the magnetic separator, such as during stripper plate maintenance or cleaning. That is, the disclosed locking mechanism prevents inadvertent passage of the magnets through respective slots during removal of the stripper plates, ensuring that the magnets remain contained in their respective apertures within a drawer and retention plate, avoiding injury if the magnets were otherwise inadvertently allowed to crash (e.g., via magnetic attraction) toward one another.

The present disclosure also provides for the magnetic separator including the housing defining the product flow path through which the material may pass, the drawer moveable between the first position and the second position, and the at least one magnet operatively connected to the drawer, with the at least one magnet positioned within the product flow path in the first position of the drawer and with the at least one magnet withdrawn from the flow path when in the second position.

The magnetic separator further includes the at least one guide rail movably coupled to the housing and supporting the drawer relative to the housing, and a compliant fastener disposed between the at least one guide rail and the drawer to and fixing together the at least one guide rail and the drawer and facilitate engagement of the drawer with the housing in the first position.

In this way, the present disclosure provides the advantage of allowing compliant coupling between the drawer and the at least one guide rail to enable a seal between the drawer and the housing in the first position. This prevents material from leaking out of the product flow path when the drawer is in the first position.

In addition, the present disclosure also provides a locking mechanism that locks each magnet such, that, during maintenance periods and when stripper plates are extracted for cleaning purposes, the locking mechanism prevents inadvertent engagement of a shoulder of the magnet with a clearance. When the drawer is pulled out during maintenance, the magnets are pulled past stripper plates such that the stripper plates can be removed. An anti-rotation mechanism is provided to ensure that the magnets pull with the drawer when the drawer is removed. However, if the magnets are inadvertently disengaged from the anti-rotation mechanism, the magnets may then turn such that they are not pulled along with the drawer, which can result in the magnets crashing against one another. Thus, according to the disclosure, the anti-rotation mechanism also includes an engagement feature that engages the ends of the magnets to avoid such inadvertent operation.

BRIEF DESCRIPTION OF THE DRAWINGS

Other objects, features, and advantages of the present disclosure will be readily appreciated as the same becomes better understood after reading the subsequent description taken in connection with the accompanying drawing wherein.

DETAILED DESCRIPTION

Figure 1:
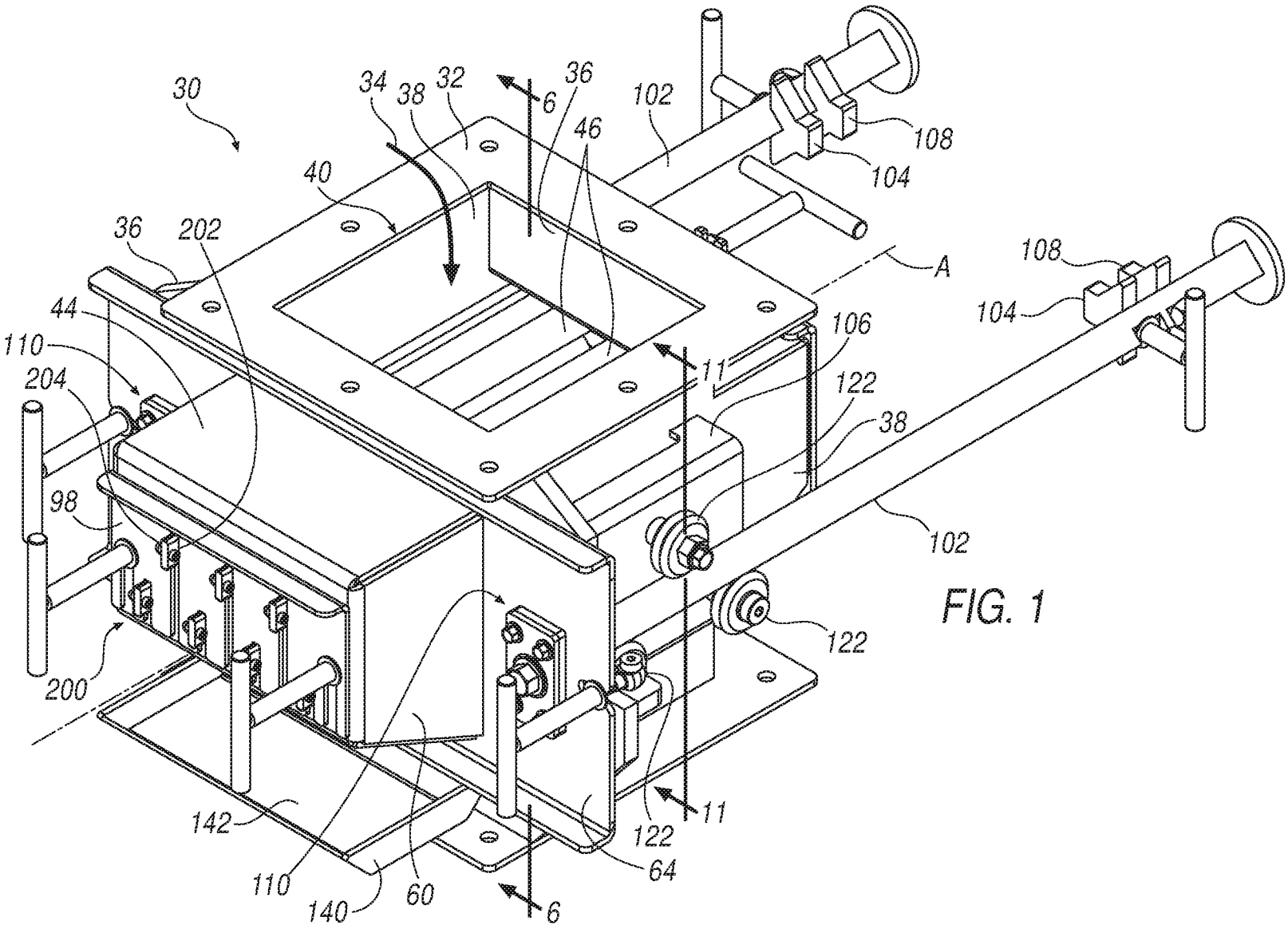
FIG. 1 is a perspective view of a magnetic separator having a housing, a drawer, and a single anti-rotation mechanism, with the drawer in a first position.
Figure 5:
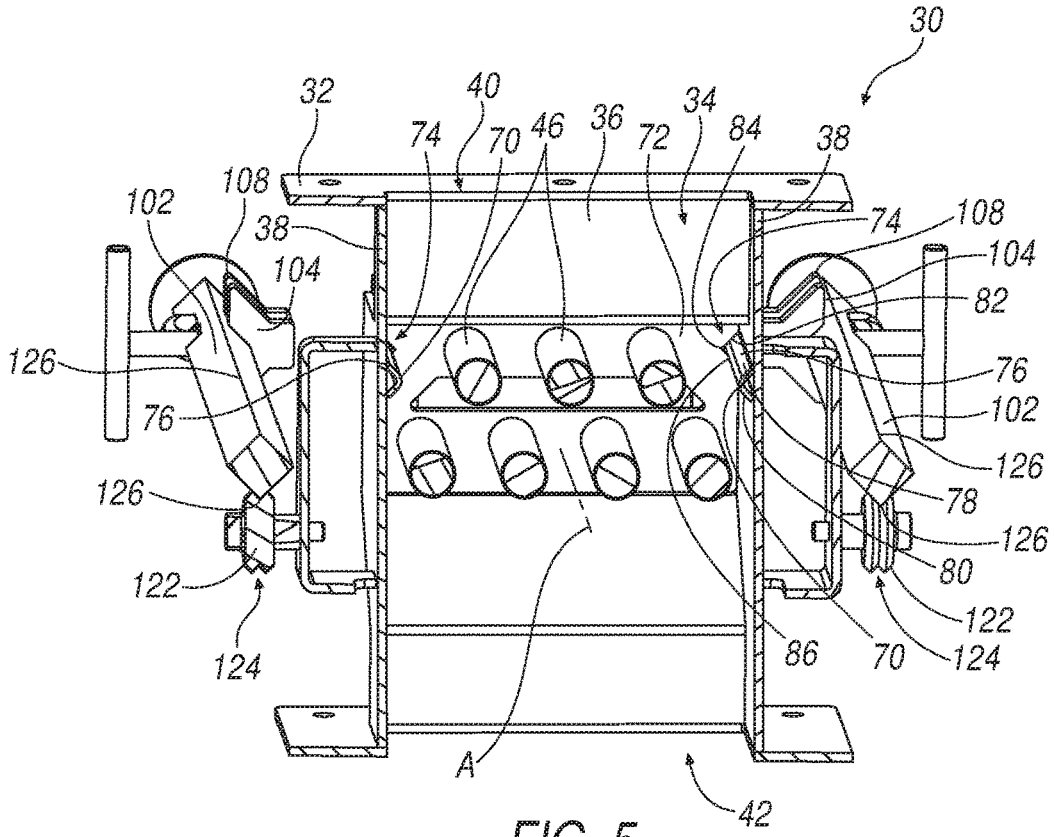
FIG. 5 is a cross-sectional, perspective view of the magnetic separator.
Figure 14:
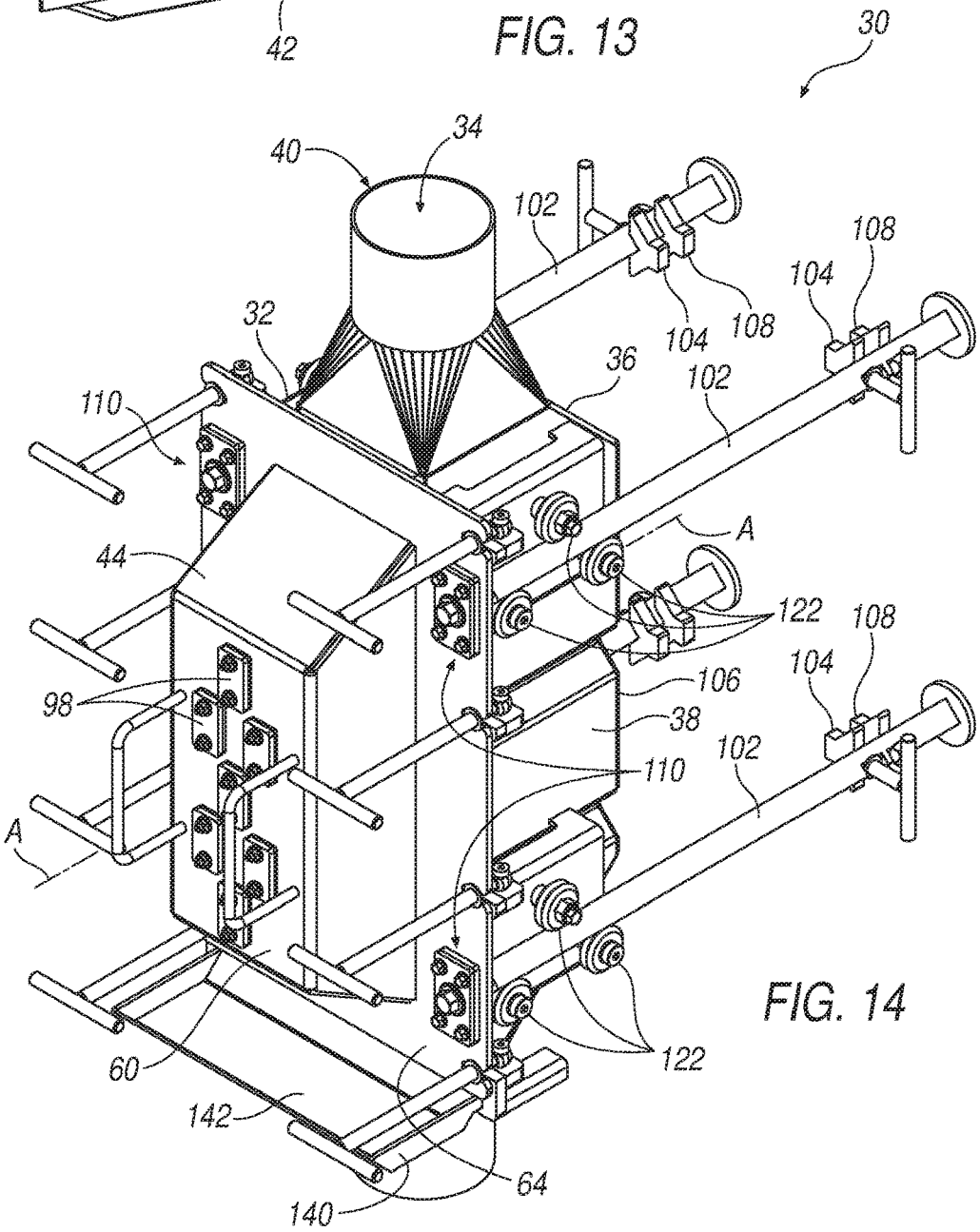
FIG. 14 is a perspective view of a magnetic separator having a plurality of anti-rotation mechanisms.

Referring now to FIGS. 1 and 14, a magnetic separator of the type employed for removing ferrous materials from a product stream is generally indicated at 30. The magnetic separator 30 includes a housing 32 defining a product flow path 34 through which material may pass. The housing 32 may have a pair of end walls 36 and a pair of side walls 38 disposed spaced from one another and extending between the end walls 36 so as to define the product flow path 34. Moreover, the housing 32 may have an entrance opening 40 and an exit opening 42 (on the underside) providing access to the product flow path 34, as shown in FIG. 5. The material passes through the product flow path 34 from the entrance opening 40 to the exit opening 42, with ferrous material removed from the remaining material. Such ferrous material is known as "tramp metal contaminants" in the related art. The magnetic separator 30 of the present disclosure may be employed for separating tramp metal contaminants from many finely ground cohesive materials, such as gypsum, barium, carbonate, fuller's earth, lime, cohesive chemicals, confectionary sugar, corn starch, flour, wood flour, and fibrous materials like chopped hay, alfalfa, flax or the like. In addition, the present disclosure may be used to remove tramp metal contaminants from grain, coffee, peanuts, and the like in the processing or handling steps of such materials.

Figure 2:
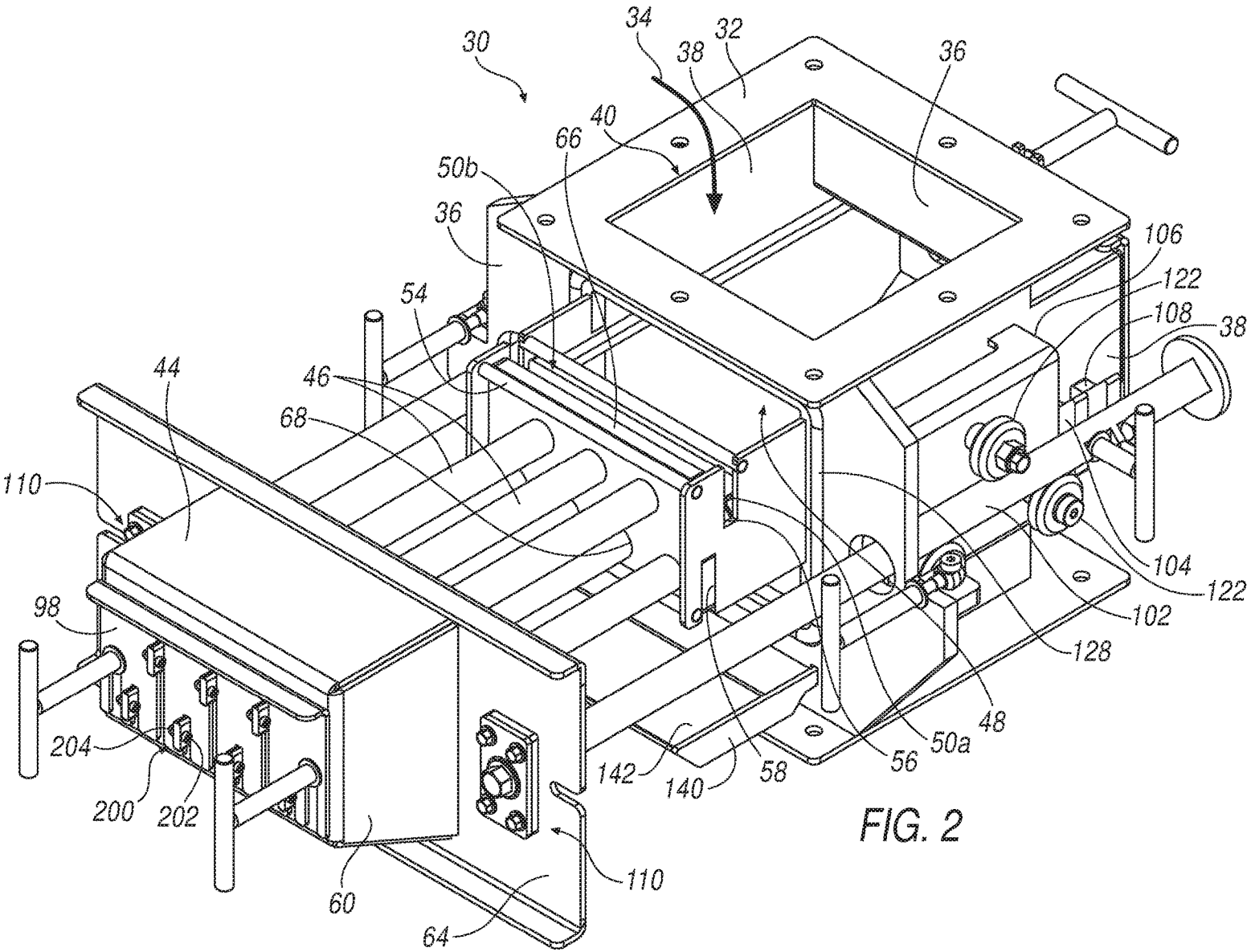
FIG. 2 is a perspective view of the magnetic separator with the drawer in a second position and showing at least one magnet and first and second stripper plates.

The magnetic separator 30 further includes a drawer 44 moveable between a first position (as shown in FIG. 1) and a second position (as shown in FIG. 2) and at least one magnet 46 operatively connected to the drawer 44. The at least one magnet 46 is positioned within the product flow path 34 in the first position of the drawer 44 and with the at least one magnet 46 withdrawn from the flow path when in the second position. More specifically, the housing 32 may have a drawer aperture 48 transverse to, and providing access to, the flow path. The at least one magnet 46 may be positioned into and out of the flow path by moving through the drawer aperture 48.

As shown in FIG. 2, the magnetic separator 30 further includes a stripper plate 50*a* and a stripper plate 50*b*, shown in two optional locations. In one example, stripper plate 50*a* is affixed to a stripper plate frame 54 and positioned over at least one magnet 46, whereas stripper plate 50*b* is generally compliant and free floating. The stripper plates 50*a*, 50*b* may be referred to singularly and individually, or collectively as stripper plates, throughout this disclosure. Reference to the stripper plate throughout this disclosure in the plural (i.e., stripper plates 50*a* 50*b*) may generally refer to one, the other, or both stripper plates. The stripper plates 50*a*, 50*b* have at least one aperture 52 corresponding to and closely conforming with the at least one magnet 46 and through which the at least one magnet 46 passes as the drawer 44 is moved between the first and second positions. The stripper plates 50*a*, 50*b* are spaced a predetermined distance from the housing 32 to define a gap therebetween with the at least one aperture 52 of the stripper plates 50*a*, 50*b* serving to strip material which has been attracted to the at least one magnet 46 off of the at least one magnet 46 in the gap as the drawer 44 is moved from the first position to the second position and the at least one magnet 46 is withdrawn from the product flow path 34.

The at least one magnet 46 may include a non-magnetic (typically stainless steel) tube having a magnetic rod supported within the tube. Moreover, the at least one magnet 46 may be a plurality of magnets 46. Furthermore, the at least one aperture 52 of the stripper plates 50*a*, 50*b* may be a plurality of apertures 52 of the stripper plates 50*a*, 50*b*, with each of the plurality of magnets 46 independently corresponding with each of the plurality of apertures 52.

The plurality of magnets 46 may be arranged in staggered rows and supported at least partially by the drawer 44 in a direction transverse to the product flow. The drawer 44 is movable between the first position, wherein the plurality of magnets 46 are positioned within the product flow path 34, and the second position wherein the plurality of magnets 46 are withdrawn from the flow path. The magnets 46 create an effective magnetic circuit for filtering the product as it flows through the flow path of the housing 32. The magnetic rod of the at least one magnet 46 may be of any type, but preferably are rare earth neodymium-iron-boron magnets, rare earth samarium-cobalt magnets for higher operating temperatures or even economical ceramic magnets for less severe tramp iron applications. Selection of the specific magnetic material will depend upon the given application.

Figure 3A:
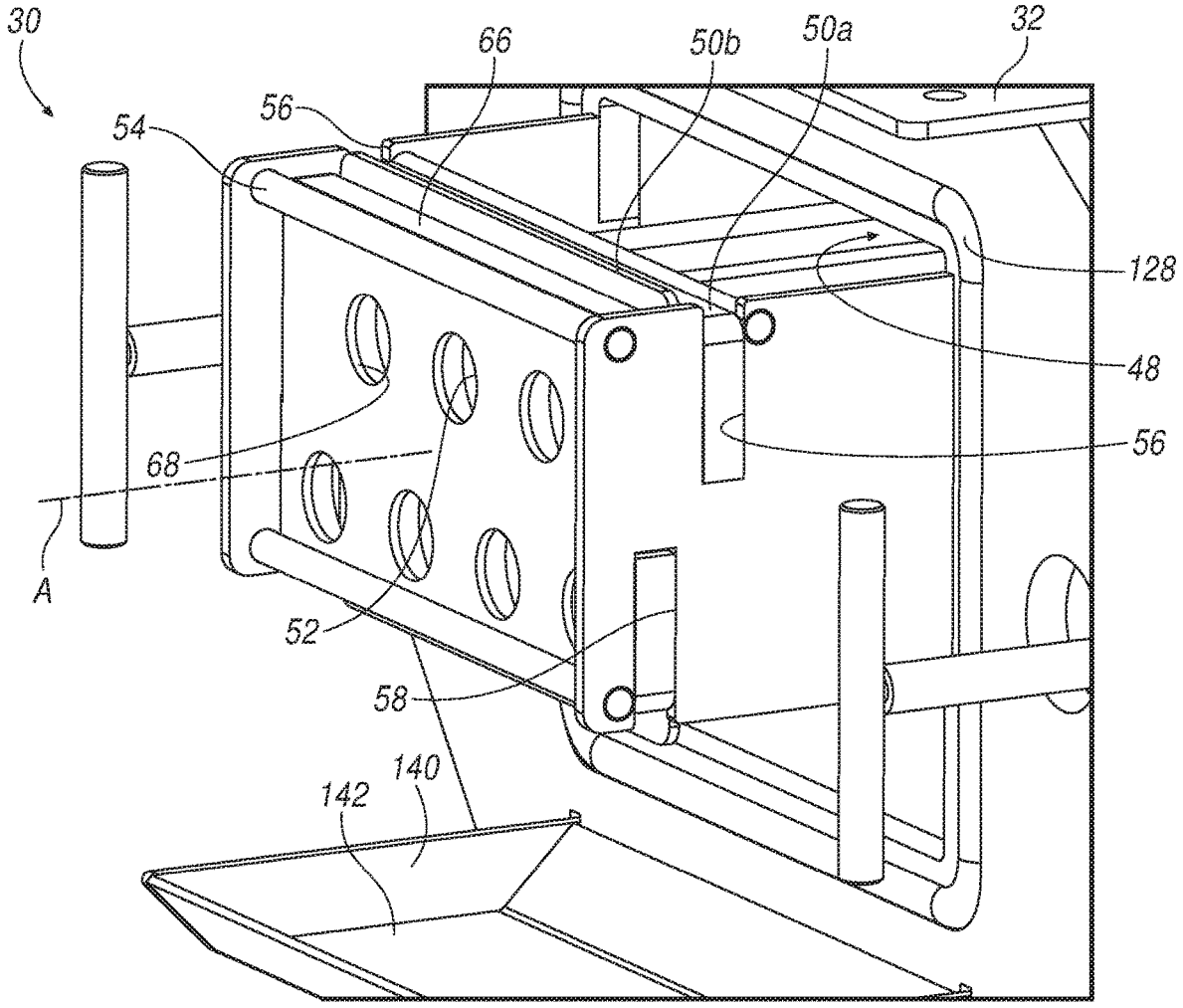
FIG. 3A is a perspective view of a stripper plate frame extending from the housing.

As shown in FIGS. 3*a*; 3*b*; and 4 and as indicated above, first stripper plate 50*a* and/or second stripper plate 50*b* are fixed to the housing 32 and having at least one aperture 52 corresponding to and closely conforming with the at least one magnet 46 through which the at least one magnet 46 passes as the drawer 44 is moved between the first and second positions. Moreover, each of the first and second stripper plates 50*a*, 50*b* may have the plurality of apertures 52 as described above.

Figure 6:
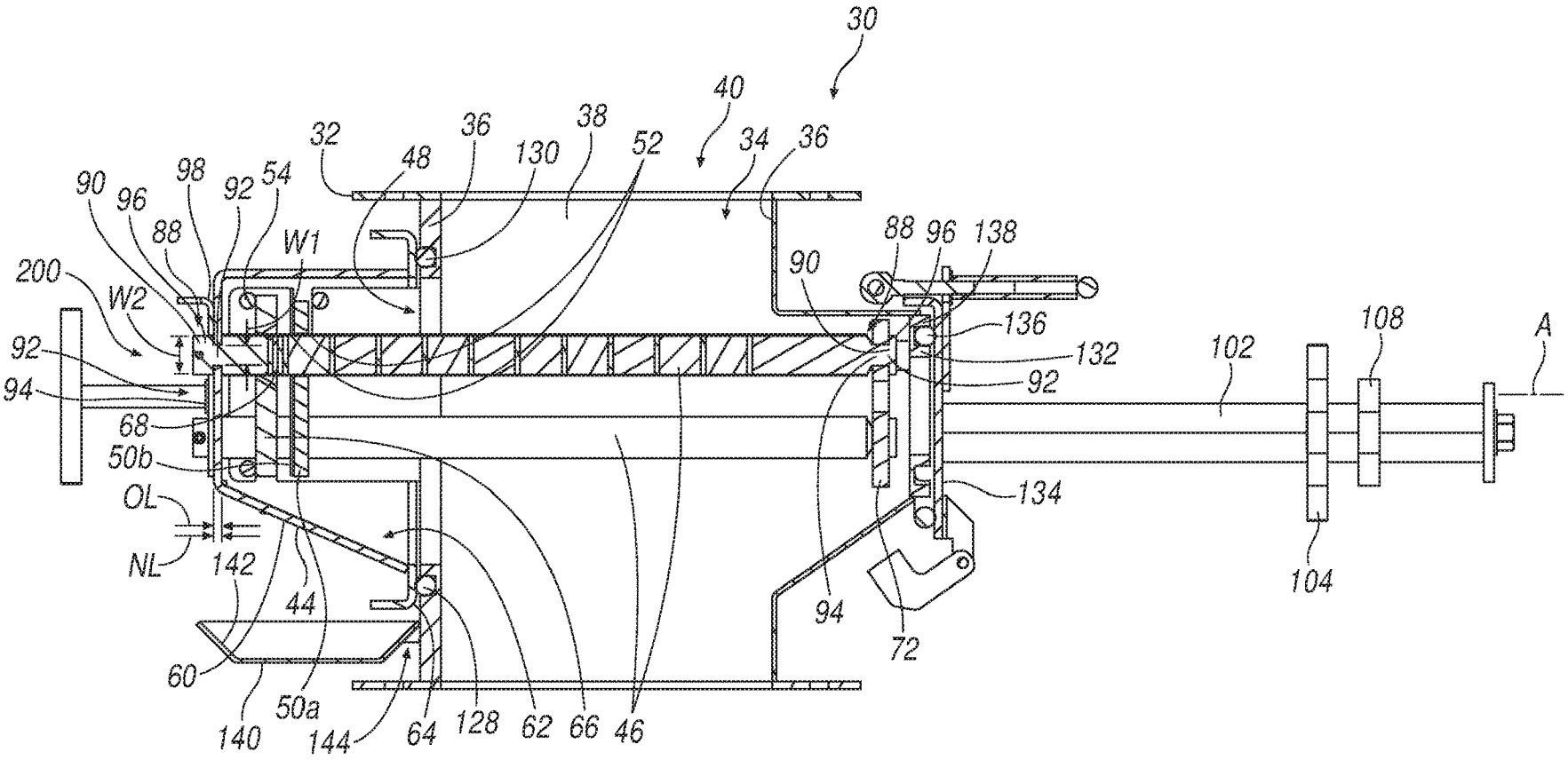
FIG. 6 is a cross-sectional view of the magnetic separator taken along 6-6 in FIG. 1.
Figure 7:
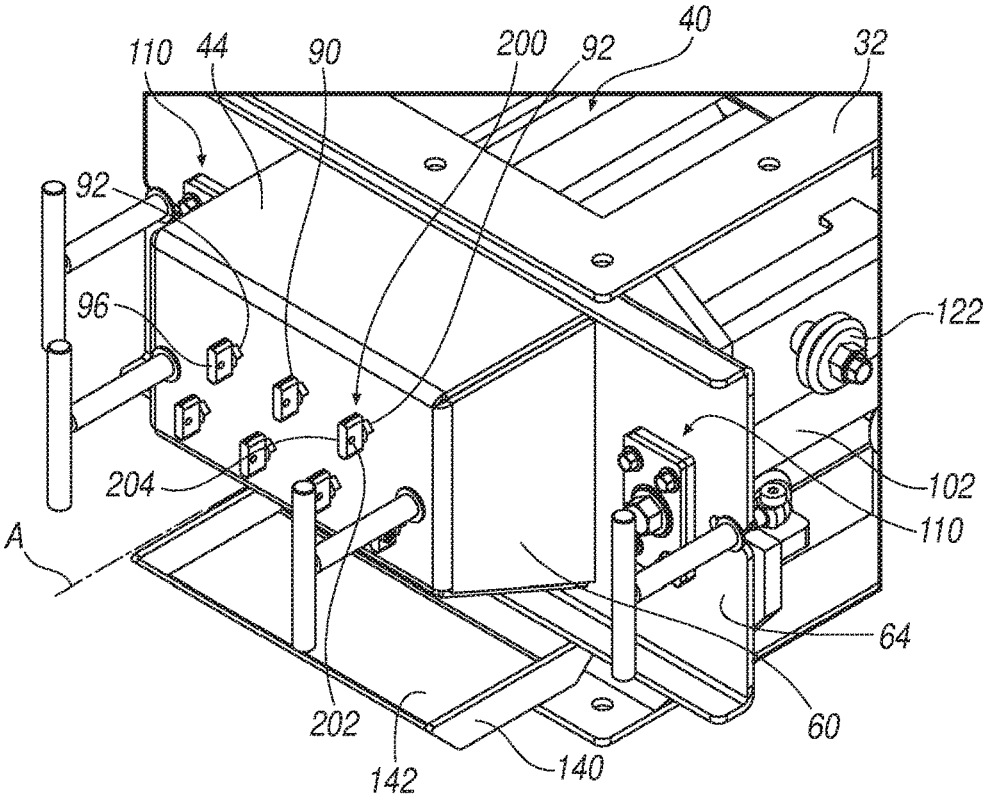
FIG. 7 is a perspective view of a portion of the magnetic separator, showing a plurality of locking mechanisms.

As described above, the stripper plates 50*a*, 50*b* are spaced a predetermined distance from the housing 32 to define a gap therebetween, as shown in FIG. 6. The at least one aperture 52 of the stripper plates 50*a*, 50*b* serves to strip material which has been attracted to the at least one magnet 46 off of the at least one magnet 46 in the gap as the drawer 44 is moved from the first position to the second position and the at least one magnet 46 is withdrawn from the product flow path 34. When the stripper plates 50*a*, 50*b* include both the first and second stripper plates 50*a*, 50*b*, the first stripper plate 50*a* may be disposed between the housing 32 and the second stripper plate 50*b*. As such, the gap may be defined between the housing 32 and the first stripper plate 50*a*. One having skill in the art will appreciate that the order of the first and second stripper plates 50*a*, 50*b* may be reversed (i.e., the second stripper plate 50*b* may be disposed between the housing 32 and the first stripper plate 50*a*).

The second stripper plate 50*b* may be spaced from the first stripper plate 50*a*. Spacing between the first and second stripper plates 50*a*, 50*b* allows ferrous material that remains on the at least one magnet 46 after passing through the first stripper plate 50*a* to be stripped off the at least one magnet 46 and outside of the housing 32 without becoming wedged between the first and second stripper plates 50*a*, 50*b*. Moreover, spacing between the first and second stripper plates 50*a*, 50*b* allows for cleaning between the first and second stripper plates 50*a*, 50*b* without necessarily removing the first and second stripper plates 50*a*, 50*b* (although removal of the first and second stripper plates 50*a*, 50*b* is possible as will be described in greater detail below).

As shown in FIG. 6, the at least one aperture 52 of the first stripper plate 50*a* may have a compliance fit with the at least one magnet 46 and the at least one aperture 52 of the second stripper plate 50*b* may have a tolerance fit with the at least one magnet 46. One having skill in the art will appreciate that a compliance fit may refer to the at least one aperture 52 being sized such that the at least one aperture 52 is at least slightly spaced from the at least one magnet 46. As such, the first stripper plate 50*a* may be configured to remove large ferrous materials from the at least one magnet 46, but smaller ferrous materials (i.e., ferrous materials small enough to fit in the space between the at least one magnet 46 and the first stripper plate 50*a* in the at least one aperture 52) may be pass through the at least one aperture 52. On the other hand, one having skill in the art will appreciate that a tolerance fit may refer to the at least one aperture 52 having a line to line fit and engaging the at least one magnet 46 entirely about the at least one aperture 52. In one example, the at least one aperture 52 has a smaller diameter than that of the at least one magnet 46, resulting in an interference fit that will further aid in capturing ferrous materials. As such, the second stripper plate 50*b* may be configured to remove smaller ferrous materials from the at least one magnet 46 (i.e., ferrous materials small enough to fit in the space between the at least one magnet 46 and the first stripper plate 50*a* in the at least one aperture 52 and continue to the second stripper plate 50*b*). In the disclosed example, there are two stripper plates 50*a*, 50*b*. However, according to the disclosure, there may be any number of stripper plates, such as one, three, four, or even more. And, in such examples, apertures 52 passing therethrough having corresponding and different diameters, such that various stages of cleansing capabilities may be accomplished to an even greater degree.

The first stripper plate 50*a* may be comprised of a material which is more rigid than the material from which the second stripper plate 50*b* is comprised. Moreover, the second stripper plate 50*b* (having the tolerance fit with the at least one magnet 46) may be comprised of a material capable of deforming as the at least one magnet 46 moves along an axis A from the first position to the second position to wipe the ferrous materials from the at least one magnet 46. For example, the first stripper plate 50*a* may be comprised of plastic, while the second stripper plate 50*b* may be comprised of a soft durometer rubber. One having skill in the art will appreciate that the first and second stripper plates 50*a*, 50*b* may be comprised of any suitable materials for removing the ferrous materials from the at least one magnet 46.

Figure 3B:
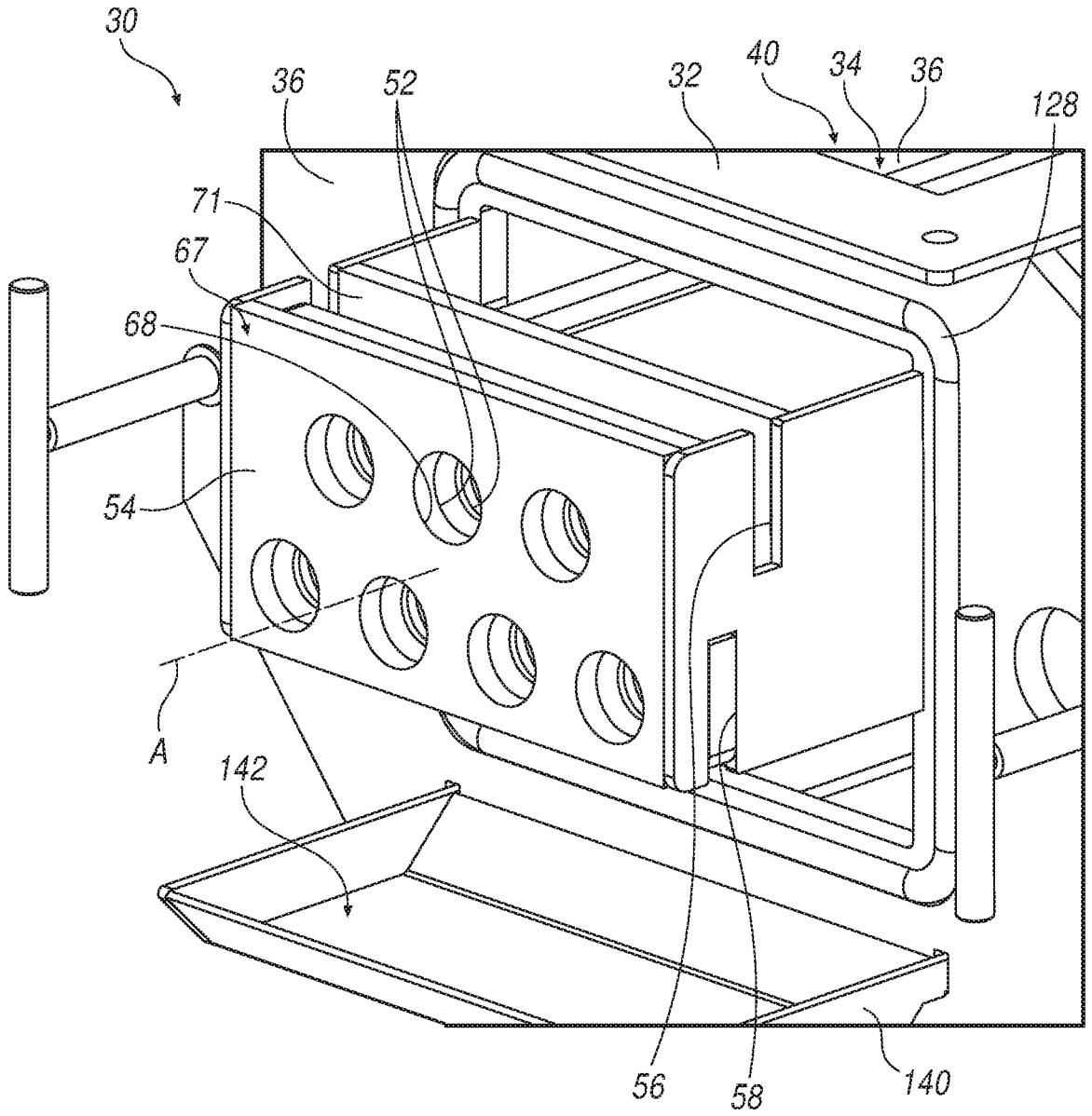
FIG. 3B is an alternative arrangement to FIG. 3A having a solid support.
Figure 4:
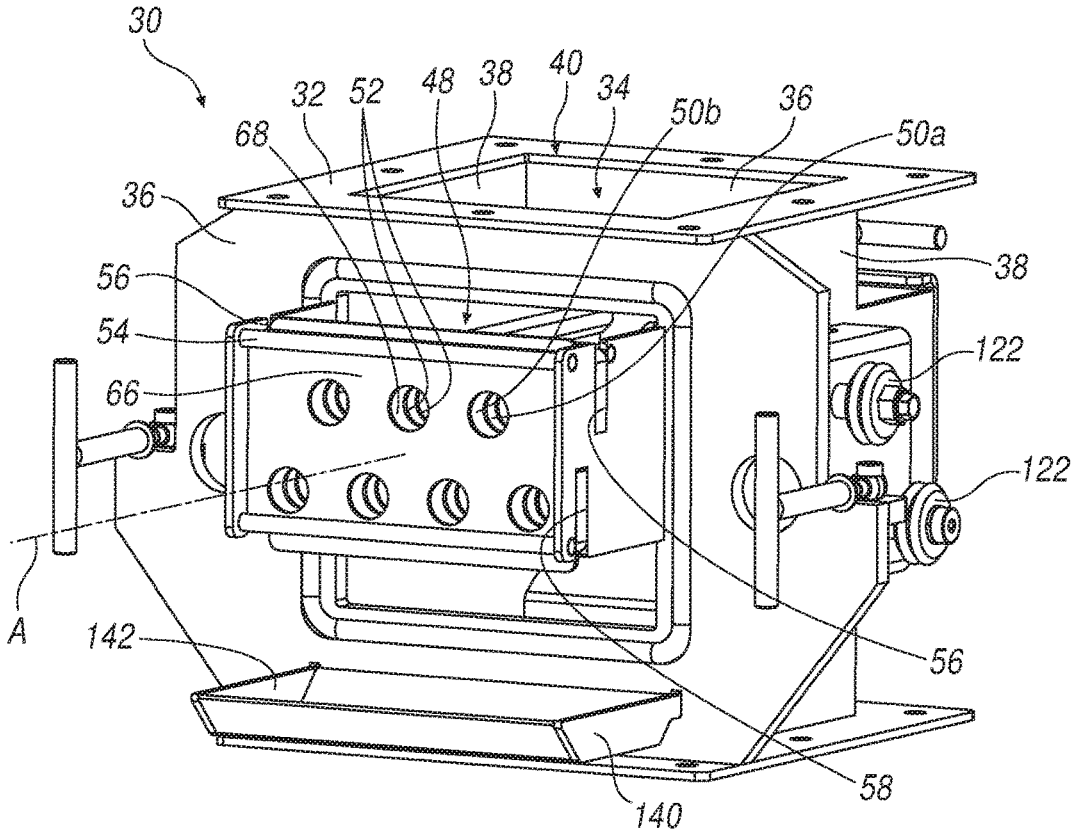
FIG. 4 is a perspective view of the first and second stripper plates coupled to the stripper plate frame and showing at least one aperture of each of the first and second stripper plates.

As shown in FIGS. 3*a*, 3*b*, and 4, the magnetic separator 30 may further include a retention plate 66. Retention plate 66 is fixed to the housing 32 via slots 58, with the first stripper plate 50*a* mounted to the stripper plate frame 54 to fix the first stripper plate 50*a* relative to the housing 32. More specifically, the stripper plate frame 54 may include a first portion and a second portion spaced from the first portion, with the first and second portions extending from the housing 32 substantially parallel to one another. Moreover, the first and second portions extend from opposing sides of the drawer aperture 48. One having skill in the art will appreciate that the stripper plate frame 54 may have any number of portions and may be arranged in any suitable configuration relative to the housing 32.

The stripper plate frame 54 may have a pair of first notches 56 for accepting and coupling the first stripper plate 50*a* to the stripper plate frame 54, and the pair of second notches 58 for accepting and coupling the retention plate 66 to the stripper plate frame 54. More specifically, the first and second portions of the stripper plate frame 54 may each have one of the pair of first notches 56 and the first and second portions of the stripper plate frame 54 may each have one of the pair of second notches 58. One having skill in the art will appreciate that the stripper plate frame 54 may have any number of notches defined in any suitable portion of the stripper plate for accepting and coupling the first stripper plate 50*a* to the stripper plate frame 54.

Figure 3C:
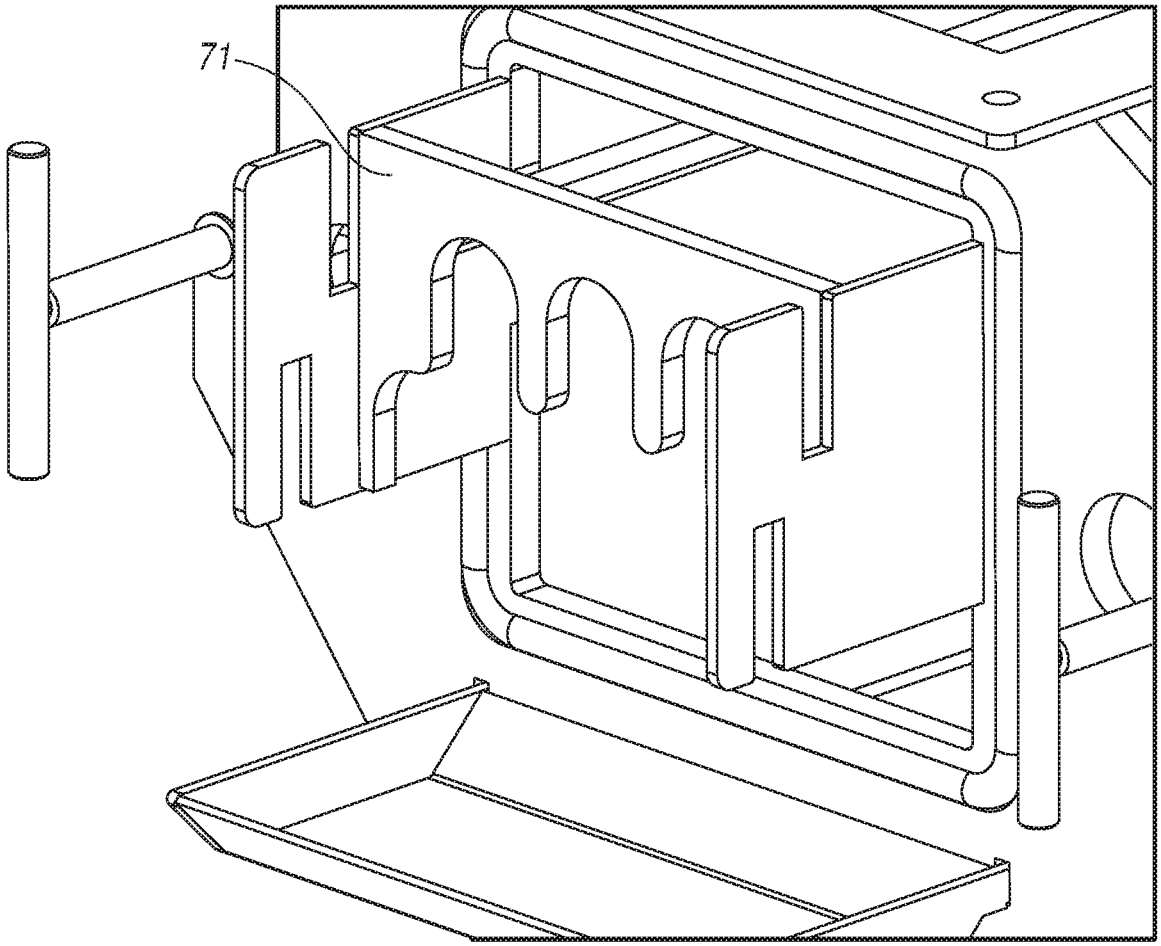
FIG. 3C is the arrangement of FIG. 3A with its solid support removed from view.

The pair of first notches 56 may open in a direction opposite the pair of second notches 58 to laterally retain the first stripper plate 50*a* and the retention plate 66 with the at least one magnet 46. More specifically, the first and second portions of the stripper plate frame 54 may each have one of the pair of first notches 56, with the pair of first notches 56 opening laterally relative to the axis A in a first direction. The first and second portions of the stripper plate frame 54 may each have one of the pair of second notches 58, with the pair of second notches 58 opening laterally relative to the axis A in a second direction, opposite the first direction. The pair of first and second notches 56, 58 allow for ease of insertion of the first stripper plate 50*a* and the retention plate 66 into the stripper plate frame 54. Moreover, referring to FIG. 3A, the stripper plate frame 54 may exert a force in a direction opposite of the opening of each of the first and second notches 56, 58 (i.e., the stripper plate frame 54 prevents further movement of the first stripper plate 50*a* and the retention plate 66 further into the first and second notches 56, 58, respectively). As such, the pair of first and second notches 56, 58 opening in opposite directions cause the first stripper plate 50*a* and retention plate 66 to exert opposing forces on each of the at least one magnet 46 extending through the at least one aperture 52 of each of the first stripper plate 50*a* and retention plate 66. In so doing, the pair of first and second notches 56, 58 opening in opposite directions may further retain the at least one magnet 46 laterally along the axis A. However, according to FIG. 3B, round rods have been replaced by a solid support 67 with apertures 68 for the magnets to pass through on the drawer front side and a solid support shaped so that tramp iron can easily fall away during a cleaning cycle on the back side, with FIG. 3C showing a corresponding support structure 71 having solid support 67 removed from view, and also not showing stripper plates 50*a*, 50*b*. And, it is contemplated that both versions perform the same function, with the solid support being stronger on wider models.

Although not shown, the pair of first and second notches 56, 58 may not open in any direction. Instead, the pair of first and second notches 56, 58 may be fully enclosed such that the first stripper plate 50*a* and retention plate 66 are coupled to the stripper plate frame 54 by inserting the first stripper plate 50*a* and retention plate 66 through the pair of first and second notches 56, 58.

As shown in FIG. 6, the drawer 44 may include a pocket 60 that is shaped to accept the stripper plate 50*a*, 50*b* therein. More specifically, the drawer 44 may define a cavity 62 adapted to accept the stripper plate 50*a*, 50*b* therein while the drawer 44 engages the housing 32 around the stripper plate 50*a*, 50*b* when the drawer 44 is in the first position. Said differently, the pocket 60 of the drawer 44 may at least partially defining the cavity 62, with the cavity 62 shaped to receive the stripper plates 50*a*, 50*b* and the stripper plate frame 54 fully within the cavity 62 when the drawer 44 is in the first position. Furthermore, the drawer 44 may have a flange 64 extending from the pocket 60 transverse to the axis A with the flange 64 configured to abut the housing 32 about the drawer aperture 48 when the drawer 44 is in the first position. As such, the drawer 44 may be configured to fully enclose the stripper plates 50*a*, 50*b* in the first position and seal against the housing 32 to prevent flow of material out of the flow path through the drawer aperture 48 in the first position. One having skill in the art will appreciate that the drawer 44 may have any suitable shape and configuration for accepting the stripper plates 50*a*, 50*b* therein in any suitable position of the drawer 44.

As shown in the figures, the magnetic separator 30 may further include the retention plate 66 mounted to the stripper plate frame 54 spaced from the housing 32. The stripper plates 50*a*, 50*b* may be disposed between the retention plate 66 and the housing 32. The retention plate 66 may have at least one hole 68 corresponding to and closely conforming with the at least one magnet 46 and through which the at least one magnet 46 passes as the drawer 44 is moved between the first and second positions. Similar to the stripper plates 50*a*, 50*b* described above, the at least one hole 68 may be a plurality of holes of the retention plate 66, with each of the plurality of magnets 46 independently corresponding with each of the plurality of holes. The retention plate 66 may further retain the at least one magnet 46 laterally along the axis A. Moreover, the retention plate 66 retains the at least one magnet 46 laterally along the axis A when the drawer 44 is moved to a third position for removal and cleaning of the stripper plates 50*a*, 50*b*, as will be described in greater detail below.

The retention plate 66 may be comprised of a material which is more rigid than the material from which the second stripper plate 50*b* is comprised. Moreover, the retention plate 66 may be comprised of the same material as the first stripper plate 50*a* as described above. For example, the retention plate 66 may be comprised of plastic. One having skill in the art will appreciate that the retention plate 66 and the first stripper plate 50*a* may be comprised of differing materials.

The retention plate 66 may also prevent the second stripper plate 50*b* from collapsing as the at least one magnet 46 moves along the axis A. More specifically, as described above, the second stripper plate 50*b* may be comprised of a material capable of deforming as the at least one magnet 46 moves along the axis A from the first position to the second position. Moreover, the first stripper plate 50*a* and the retention plate 66 may be comprised of a material which is more rigid than the material from which the second stripper plate 50*b* is comprised. The second stripper plate 50*b* may be positioned between the first stripper plate 50*a* and the retention plate 66. Moreover, the second stripper plate 50*b* may be spaced from, but in close proximity with, the first stripper plate 50*a* and the retention plate 66. As such, the second stripper plate 50*b* may deform and be pulled with the at least one magnet 46 toward the retention plate 66 when the drawer 44 moves from the first position to the second position. Likewise, the second stripper plate 50*b* may deform and be pulled with the at least one magnet 46 toward the first stripper plate 50*a* when the drawer 44 moves from the second position to the first position. As such, the spacing between the first stripper plate 50*a* and the retention plate 66 may be enough to allow sufficient deformation of the second stripper plate 50*b* to wipe the ferrous material off the at least one magnet 46.

In this way, the present disclosure provides the advantage of the stripper plate being spaced from the housing 32, preventing the stripper plate from sticking to the housing 32 and thereby resulting in captured material being stripped off the at least one magnet 46 and falling back into the product flow path 34. Moreover, the present disclosure allows for removal of the stripper plate, without the need of a tool, to allow for easy cleaning of the stripper plate. Moreover, the stripper plate is coupled to the housing 32 without fasteners, which may be unsanitary, thereby improving the sanitary condition of the magnetic separator 30. That is, when drawer 44 is moved to the third position, the at least one magnet 46 may be disconnected from a tube support 72 in order to pass the at least one magnet 46 to retention plate 66, which supports each of the at least one magnets 46 at a location that frees each of the stripper plates 50*a*, 50*b* so that they may be removed from their respective areas in which they are mounted. However, referring to FIG. 16, a locking mechanism 200 includes a fastener 202 attached to a shoulder 96 of each magnet 46 that prevents the magnet 46 from passing through respective keyed openings 92, which may result from an unintended rotation of the magnet 46 during maintenance of the magnetic separator, such as during stripper plate maintenance or cleaning. Each locking mechanism 200 includes a nut 204 and bolt 206 That is, the disclosed locking mechanism 200 prevents inadvertent passage of the magnets 46 through respective slots during removal of the stripper plates 50*a*, 50*b*, ensuring that the magnets 46 remain contained in their respective apertures 68 within drawer 44 and retention plate 66, avoiding injury if any one of magnets 46 were otherwise inadvertently allowed to crash (e.g., via magnetic attraction) toward one another during removal or replacement of stripper plates 50*a*, 50*b*.

The subject disclosure may also provide for the magnetic separator 30 including the housing 32 defines the product flow path 34 through which the material may pass. The housing 32 has a pair of diverters 70 opposing one another and extending into the product flow path 34.

The magnetic separator 30 includes the drawer 44 moveable between the first position and the second position (shown in FIGS. 1 and 2, respectively) and the at least one magnet 46 operatively connected to the drawer 44, with the at least one magnet 46 positioned within the product flow path 34 in the first position of the drawer 44 and with the at least one magnet 46 withdrawn from the flow path when in the second position.

As shown in FIG. 5, the magnetic separator 30 includes the tube support 72 disposed within the product flow path 34. The at least one magnet 46 is operatively connected to the tube support 72. The tube support 72 has a pair of slots 74 corresponding to and adapted to receive the pair of diverters 70 therein such that the pair of diverters 70 guide the movement of the tube support 72, the at least one magnet 46, and the drawer 44 between the first and second positions.

The drawer 44 may be movable along the axis A, with the pair of diverters 70 extending longitudinally along the axis A. More specifically, the pair of diverters 70 may individually extend from the side walls 38 and into the product flow path 34, with the pair of diverters 70 extending longitudinally along the axis A substantially parallel to the at least one magnet 46 between the pair of end walls 36. The material moving through the product flow path 34 along the side walls 38 engage the pair of diverters 70 and is redirected, at least partially, inwardly toward a center of the product flow path 34. In doing so, the material is directed toward, and into proximity with, the at least one magnet 46 such that ferrous material is drawn to the at least one magnet 46. One having skill in the art will appreciate that the pair of diverters 70 may be positioned in any suitable location and orientation within the product flow path 34.

Each of the pair of diverters 70 may have a guide surface 76 having an angular configuration, with the angular configuration providing a resultant force transverse to the axis A to retain the movement of the tube support 72 along the axis A. As shown in the FIG. 5, the angular configuration of the guide surface 76 may refer to the guide surface 76 extending at angle transverse to the side walls 38. Moreover, the angular configuration of the guide surface 76 may refer to the guide surface 76 having a plurality of angles that are transverse to the side walls 38. For example, as shown in FIG. 5, the guide surface 76 of each of the pair of diverters 70 may have a first section 78 and a second section 80 each disposed at an independent angle such that the first and second sections 78, 80 of each of the pair of guide surfaces 76 meet to form an apex. More specifically, the first section 78 of the guide surface 76 may extend at an angle downwardly toward the axis A while the second section 80 of the guide surface 76 may extend at an angle upwardly toward the axis A. As such, each of the pair of diverters 70 may have a substantially triangular cross-section along the axis A. One having skill in the art will appreciate that the pair of diverters 70 may have any suitable shape and configuration.

Each of the pair of slots 74 may have an engagement surface 82 corresponding to and adapted to engage the guide surfaces 76 of the pair of diverters 70, with the engagement surfaces 82 having an angular configuration corresponding to the angular configuration of the guide surfaces 76. As shown in FIG. 5, the angular configuration of the engagement surface 82 may refer to the engagement surface 82 surface extending at angle transverse to the side walls 38 of the housing 32. Moreover, the angular configuration of the engagement surface 82 may refer to the engagement surface 82 having a plurality of angles that are transverse to the side walls 38. For example, as shown in FIG. 5, the engagement surface 82 of each of the pair of slots 74 may have a first portion 84 and a second portion 86 each disposed at an independent angle such that the first and second portions 84, 86 of each of the pair of engagement surfaces 82 meet to form an apex. More specifically, the first portion 84 of the engagement surface 82 may extend at an angle downwardly toward the axis A while the second portion 86 of the engagement surface 82 may extend at an angle upwardly toward the axis A. As such, each of the pair of slots 74 may have a substantially triangular cross-section along the axis A. One having skill in the art will appreciate that the pair of diverters 70 may have any suitable shape and configuration.

The engagement surface 82 of each of the pair of slots 74 may be shaped and oriented such that each guide surface 76 of the pair of diverters 70 independently engages the engagement surface 82 of each of the pair of slots 74. As such, the pair of diverters 70 may be configured to independently nest within each of the pair of slots 74.

The nesting of the diverters 70 within the pair of slots 74, as well as the angular configuration of the guide surface 76 retains the movement of the drawer 44, the at least one magnet 46, and the tube support 72 along the axis A. More specifically, the opposing configuration of the pair of diverters 70 and the pair of slots 74 prevents movement of the tube support 72 toward both of the side walls 38. Moreover, the angular configuration of the guide surface 76 of each of the pair of diverters 70 and the engagement surface 82 of each of the pair of slots 74 facilitates abutment of the guide surfaces 76 with the engagement surfaces 82 when the tube support 72 moves toward either of the entrance and exit openings 40, 42.

In this way, the present disclosure provides the advantage of the tube support 72 utilizing the pair of diverters 70 of the housing 32 to support the tube support 72, which eliminates the need of a separate rail system to support the tube support 72. Moreover, eliminating the need for a separate rail system reduces the number of components within the product flow path 34, each of which could be unsanitary, and thereby improves the overall sanitation of the magnetic separator 30.

The subject disclosure may also provide for the magnetic separator 30 including the housing 32 defining the product flow path 34 through which the material may pass and the drawer 44 moveable between the first position and the second position (as shown in FIGS. 1 and 2, respectively). The magnetic separator 30 further includes the tube support 72 disposed within the product flow path 34 and the at least one magnet 46, as shown in FIG. 6. The at least one magnet 46 extends between a pair of ends 88. More specifically, the at least one magnet 46 may extend along the axis A between the pair of ends 88. The at least one magnet 46 may be operatively connected to each of the drawer 44 and the tube support 72, with the at least one magnet 46 positioned within the product flow path 34 in the first position of the drawer 44 and with the at least one magnet 46 withdrawn from the flow path when in the second position.

The magnetic separator 30 includes a locking mechanism 90 extending from at least one of the pair of ends 88. At least one of the drawer 44 and the tube support 72 defines at least one keyed opening 92 corresponding to and adapted to accept the locking mechanism 90 of the at least one magnet 46. The locking mechanism 90 is rotatable between an unlocked position, in which the locking mechanism 90 may freely move into and out of the keyed opening 92, and a locked position, in which the locking mechanism 90 is retained in the keyed opening 92. When drawer 44 is moved to the third position, the at least one magnet 46 may be disconnected from the tube support 72 in order to pass the at least one magnet 46 to retention plate 66, which supports each of the at least one magnets 46 at a location that frees each of the stripper plates 50*a*, 50*b* so that they may be removed from their respective areas in which they are mounted.

Figure 16:
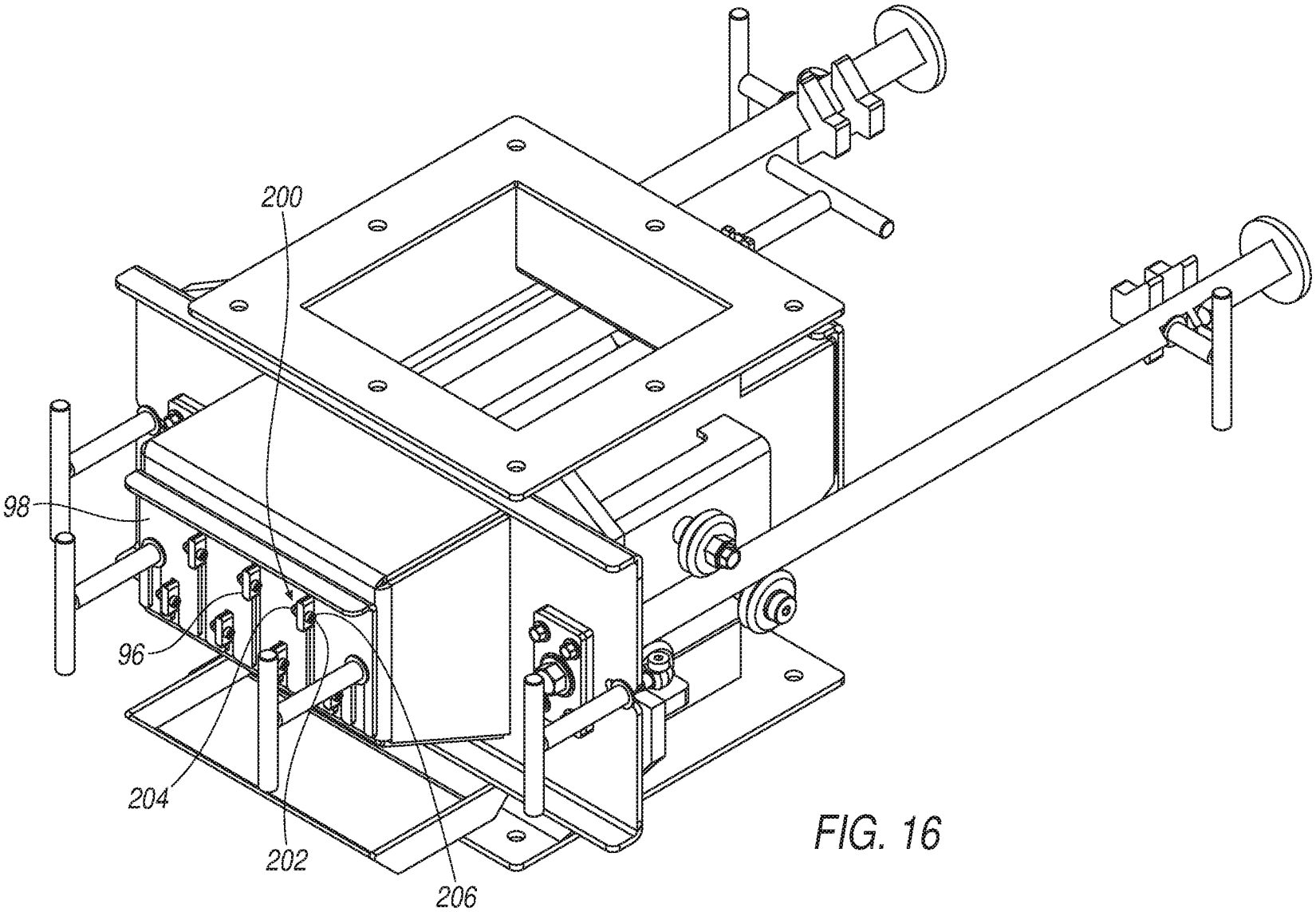
FIG. 16 illustrates the disclosed locking mechanism that includes a fastener attached to a shoulder of each magnet that prevents the magnet from passing through each respective keyed opening.

However, referring to FIG. 16, locking mechanism 200 corresponds with locking mechanism 90 and is shown in other figures includes a fastener 202 attached to shoulder 96 of each magnet 46 that prevents the magnet 46 from passing through each respective keyed opening 92, which may result from an unintended rotation of the magnet 46 during maintenance of the magnetic separator, such as during stripper plate maintenance or cleaning. Each locking mechanism 200 includes a nut 204 and bolt 206 That is, the disclosed locking mechanism 200 prevents inadvertent passage of the magnets 46 through respective slots during removal of the stripper plates 50*a*, 50*b*, ensuring that the magnets 46 remain contained in their respective apertures 68 within drawer 44 and retention plate 66, avoiding injury if any one of magnets 46 were otherwise inadvertently allowed to crash (e.g., via magnetic attraction) toward one another during removal or replacement of stripper plates 50*a*, 50*b*.

As described above, either of the at least one of the drawer 44 and the tube support 72 may define the at least one keyed opening 92 corresponding to adapted to accept the locking mechanism 90 of the at least one magnet 46. Therefore, the description of the locking mechanism 90 and the keyed opening 92 below is applicable to the engagement of the locking mechanism 90 with both of the at least one of the drawer 44 and the tube support 72. As a result, common components between each embodiment will use common numbering.

As shown in FIG. 6, the locking mechanism 90 may have a neck 94 and a shoulder 96 fixed to the neck 94, with the neck 94 extending from the at least one magnet 46 through the keyed opening 92 and with the shoulder 96 and the at least one magnet 46 disposed on opposing sides of the at least one of the drawer 44 and the tube support 72. Said differently, the locking mechanism 90 may extend through the keyed opening 92 to position the shoulder 96 and the at least one magnet 46 on opposing sides of the at least one of the drawer 44 and the tube support 72. The shoulder 96 may be engageable with the at least one of the drawer 44 and the tube support 72 in the locked position to retain the locking mechanism 90 in the keyed opening 92 and couple the at least one magnet 46 to the at least one of the drawer 44 and the tube support 72. Magnets 46, as illustrated in FIG. 16, may include additional locking mechanism 200 that includes fastener 202 attached to shoulder 96 of each magnet 46 that prevents the magnet 46 from passing through each respective keyed opening 92, which may result from an unintended rotation of the magnet 46 during maintenance of the magnetic separator, such as during stripper plate maintenance or cleaning. The disclosed locking mechanism 200 prevents inadvertent passage of the magnets 46 through respective slots during removal of the stripper plates 50*a*, 50*b*, ensuring that the magnets 46 remain contained in their respective apertures 68 within drawer 44 and retention plate 66, avoiding injury if any one of magnets 46 were otherwise inadvertently allowed to crash (e.g., via magnetic attraction) toward one another during removal or replacement of stripper plates 50*a*, 50*b*.

Figure 8:
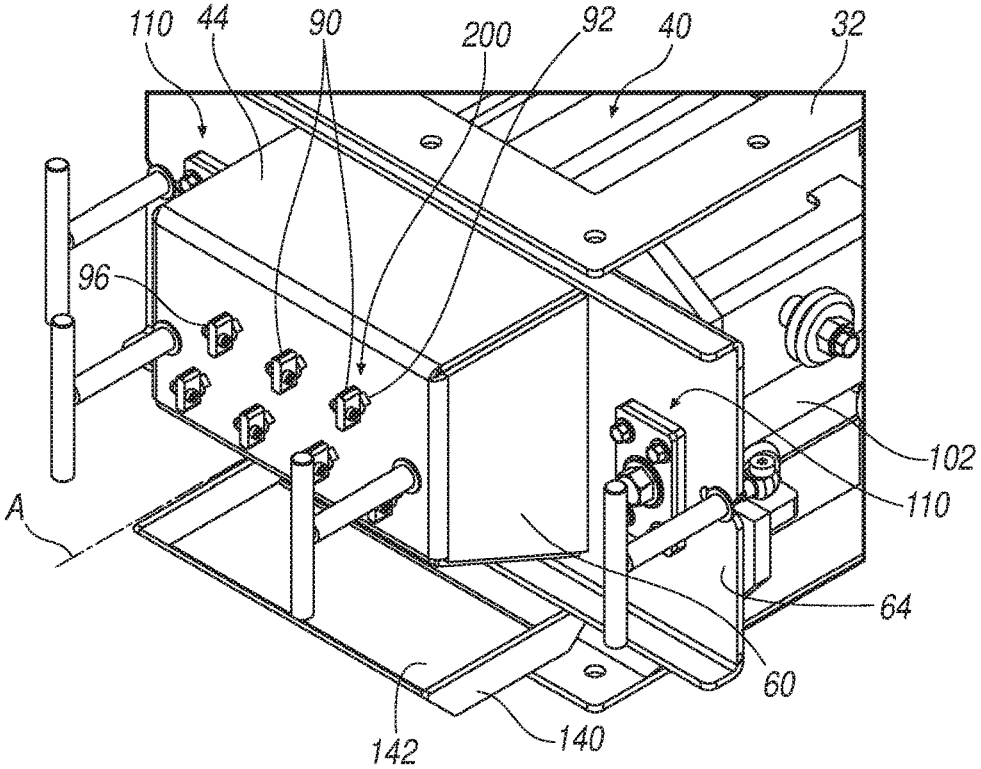
FIG. 8 is a perspective view of a portion of the magnetic separator, with the drawer having a plurality of keyed openings and the plurality of locking mechanisms individually corresponding with the plurality of keyed openings.

As shown in FIG. 8, the keyed opening 92 and the shoulder 96 of the locking mechanism 90 may have a substantially rectangular configuration, with the substantially rectangular configurations symmetrically aligned in the unlocked position to allow free movement of the shoulder 96 into and out of the keyed opening 92, and with the substantially rectangular configurations asymmetrically aligned in the locked position to retain the locking mechanism 90 in the keyed opening 92. More specifically, both the keyed opening 92 and the shoulder 96 may have a similarly-sized rectangular shape which allows the shoulder 96 to be inserted through the keyed opening 92 in the unlocked position. One having skill in the art will appreciate that the shoulder 96 and the keyed opening 92 may be any suitable shape and configuration, including different shapes and configurations between the shoulder 96 and the keyed opening 92.

As shown in FIG. 6, each of the neck 94 and the shoulder 96 may have a width dimension W1, W2. The width dimension W2 of the shoulder 96 may be greater than the width dimension W1 of the neck 94. As such, the shoulder 96 may extend radially beyond the neck 94 to facilitate engagement of the shoulder 96 with the drawer 44 and/or the tube support 72. Moreover, the keyed opening 92 may have an opening length OL and the neck 94 may have a neck length NL. The neck length NL of the neck 94 may be at least equal to the opening length OL of the keyed opening 92 to facilitate positioning of the shoulder 96 and the at least one magnet 46 on the opposing sides of the at least one of the drawer 44 and the tube support 72. Said differently, the neck length NL of the neck 94 may be greater than or equal to the opening length OL of the keyed opening 92 such that the drawer 44 and/or the tube support 72 is disposed between the shoulder 96 and the at least one magnet 46.

The rotation of the locking mechanism 90 may facilitate the symmetric alignment of the shoulder 96 and the keyed opening 92 in the unlocked position and the asymmetric alignment of the shoulder 96 and the keyed opening 92 in the locked position. More specifically, the rotation of the locking mechanism 90 may orient the locking mechanism 90 relative to the keyed opening 92. When rotated to the unlocked position, the locking mechanism 90 and the keyed opening 92 may be aligned such that the shape of the shoulder 96 and the shape of the keyed opening 92 are symmetric and the locking mechanism 90 is capable of passing through the keyed opening 92. When rotated to the locked position, the locking mechanism 90 and the keyed opening 92 may be aligned such that the shape of the shoulder 96 and the shape of the keyed opening 92 are asymmetric and the shoulder 96 of the locking mechanism 90 will abut the drawer 44 and/or the tube support 72 when attempting to pass through the keyed opening 92.

Although operative examples pertaining to the size and shape of the locking mechanism 90 and the keyed opening 92 are described above, one having skill in the art will appreciate that the locking mechanism 90 and the keyed opening 92 may be any suitable size, shape, and configuration, including different sizes, shapes, and configurations between the shoulder 96 and the keyed opening 92, to facilitate free movement of the locking mechanism 90 into and out of the keyed opening 92 in the unlocked position, and retention of the locking mechanism 90 the keyed opening 92 in the locked position, which in-turn couples the at least one magnet 46 to the drawer 44 and/or the tube support 72.

As described above, the at least one locking mechanism 90 engages at least one of the drawer 44 and the tube support 72. As such, it is to be appreciated that the at least one locking mechanism 90 may be further defined as a pair of locking mechanisms 90 individually extending from the pair of ends 88, with both of the drawer 44 and the tube support 72 defining the at least one keyed opening 92, as shown in FIG. 6. Therefore, the pair of locking mechanisms 90 collectively couple the at least one magnet 46 to the drawer 44 and the tube support 72.

Each of the pair of locking mechanisms 90 may be fixed to the at least one magnet 46. Said differently, the pair of locking mechanisms 90 may rotate with the at least one magnet 46. As such, each of the pair of locking mechanisms 90 may be rotatable together, with each of the locking mechanisms 90 independently having an unlocked position. More specifically, the keyed opening 92 of the drawer 44 and the keyed opening 92 of the tube support 72 may be rotatably offset such that each of the pair of locking mechanisms 90 are aligned in their respective unlocked position with their respective keyed opening 92 in different rotational positions of the at least one magnet 46 and the pair of locking mechanisms 90 (i.e., the at least one magnet 46 and the pair of locking mechanisms 90 must be rotated to different positions which independently release the magnet 46 from the drawer 44 and from the tube support 72). As such, when one of pair the locking mechanisms 90 is in the unlocked position, the other one of the pair of locking mechanisms 90 is in the locked position, and vice versa. Furthermore, the at least one magnet 46 and the pair of locking mechanisms 90 may be rotatable to a position between the unlocked positions of the pair of locking mechanisms 90 in which both of the pair of locking mechanisms 90 are in the locked position. As such, the locked position may be further defined as a plurality of locked positions.

Moreover, the shape of each of the locking mechanisms 90 with each of the keyed openings 92 may result in more than one position in which each locking mechanism 90 is in the unlocked position. For example, when the shoulder 96 and the keyed opening 92 have the rectangular configuration, the unlocked position may be a pair of unlocked positions 180 degrees apart. Therefore, the unlocked position of each locking mechanism 90 may be a plurality of unlocked positions.

One having skill in the art will appreciate that the pair of locking mechanisms 90 may rotate independent of one another and may rotate independent of the at least one magnet 46.

As described above, the at least one magnet 46 may be further defined as the plurality of magnets 46. Each of the plurality of magnets 46 may have the locking mechanism 90, and the at least one keyed opening 92 may be further defined as a plurality of keyed openings 92 individually corresponding with the plurality of magnets 46, as shown in FIG. 8. Moreover, each of the plurality of magnets 46 may include the pair of locking mechanism 90 with each of the drawer 44 and the tube support 72 having the plurality of keyed openings 92.

As shown in FIGS. 1 and 14, the magnetic separator 30 may further include an anti-rotation mechanism 98 mounted to the drawer 44 and engaging the locking mechanism 90 in the locked position to retain the locking mechanism 90 in the locked position. The anti-rotation mechanism 98 may have a planar configuration and may be mounted to the drawer 44 to cover the respective locking mechanism 90 (i.e., the shoulder 96 of the locking mechanism 90 may be between the anti-rotation mechanism 98 and the drawer 44). The anti-rotation mechanism 98 is operatively shown in the Figures mounted to the drawer 44.

The anti-rotation mechanism 98 may include a single anti-rotation mechanism 98 engaging each locking mechanism 90 of the plurality of magnets 46 when in the locked position, as shown in FIG. 1. The single anti-rotation mechanism 98 may be used in a configuration of the magnetic separator 30 that is gravity fed. More specifically, the material flows through the product flow path 34 from the entrance opening 40 to the exit opening 42 by way of gravity causing movement of the material. Alternatively, the anti-rotation mechanism 98 may include a plurality of anti-rotation mechanisms 98 each individually engaging the locking mechanism 90 of the plurality of magnets 46 when in the locked position, as shown in FIG. 14. The plurality of anti-rotation mechanisms 98 may be used in a configuration of the magnetic separator 30 that is pneumatic fed. More specifically, the material flows through the product flow path 34 from the entrance opening 40 to the exit opening 42 by way of fluid pressure causing movement of the material. As shown in the Figures, the anti-rotation mechanism 98 may be coupled to the drawer 44 by a mechanical fastener; however, one having skill in the art will appreciate that the anti-rotation mechanism 98 may be coupled to the drawer 44 in any suitable manner.

Figure 15:
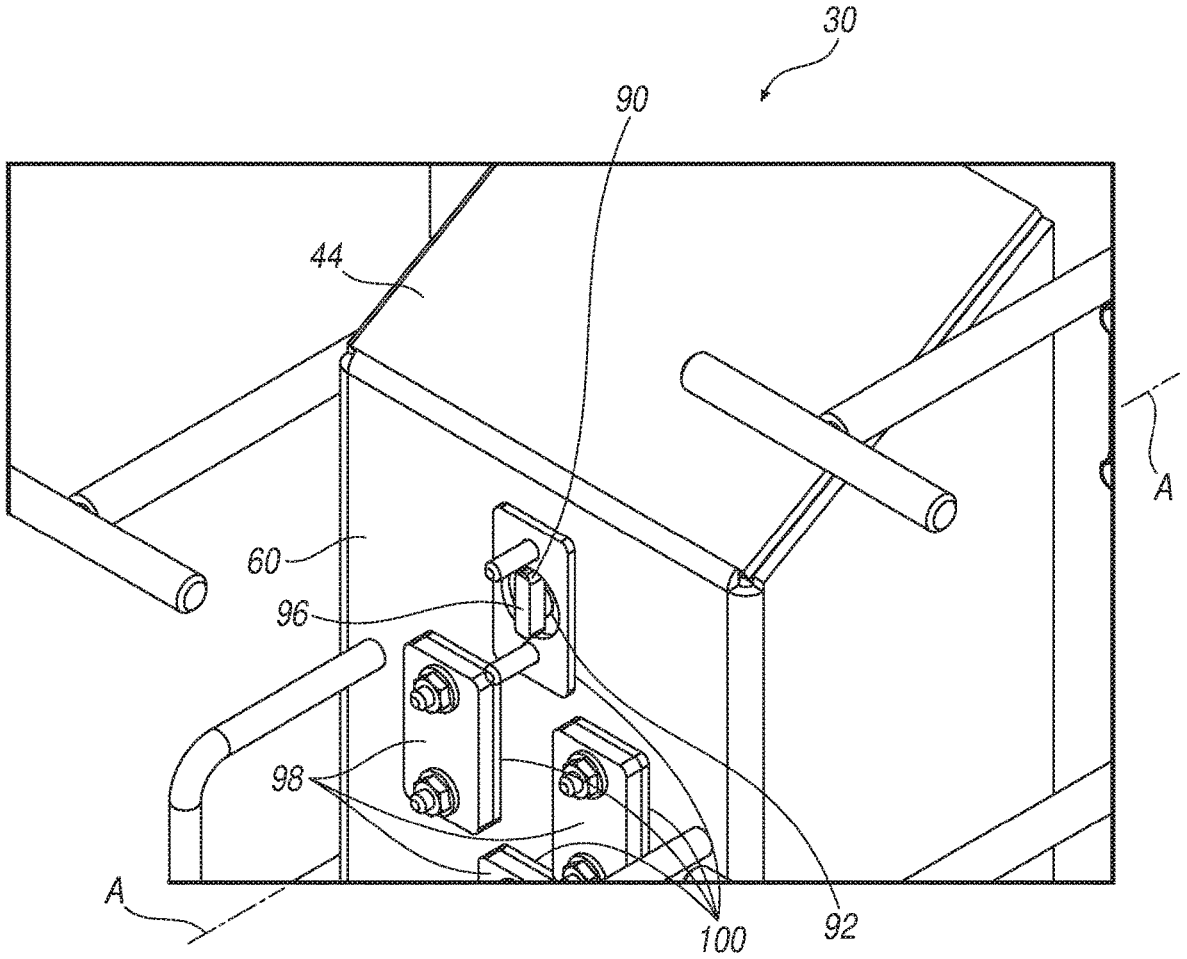
FIG. 15 is a perspective view of a portion of the magnetic separator shown in FIG. 14, with one of the plurality of anti-rotation mechanisms removed to show the locking mechanism.

As shown in FIG. 15, the magnetic separator 30 may further include a deformable gasket 100 between the anti-rotation mechanism 98 and the drawer 44, with the deformable gasket 100 conforming positioning of the anti-rotation mechanism 98 relative to the locking mechanism 90 to ensure engagement of the anti-rotation mechanism 98 with the locking mechanism 90 in the locked position. More specifically, the deformable gasket 100 may have at least one hole with the shoulder 96 of the locking mechanism 90 at least partially disposed within the hole. In one example (not shown), the deformable gasket 100 is a single deformable gasket 100 having a plurality of holes individually corresponding with the plurality of locking mechanisms 90. In this example, the single deformable gasket 100 is typically used with the single anti-rotation mechanism 98, but may be used with the plurality of anti-rotation mechanisms 98 (such as shown in FIG. 15). As seen in FIG. 15, the deformable gasket 100 is a plurality of deformable gaskets 100 each having the hole, with the plurality of deformable gaskets 100 individually corresponding with the plurality of locking mechanisms 90. The plurality of deformable gaskets 100 are typically used with the plurality of anti-rotation mechanisms 98, but may be used with the single anti-rotation mechanism 98 (shown in FIG. 9).

The deformable gasket 100 allows for variations between the anti-rotation mechanism 98 and the drawer 44. Furthermore, when mounted to the drawer 44, the deformable gasket 100 seals between the anti-rotation mechanism 98 and the drawer 44 about the keyed opening 92 to prevent outflow of product flow, and prevent the transmission of the pathogens into the product flow path 34 when the drawer 44 is the first position, which is a sterile field.

In this way, the present disclosure provides the advantage of the at least one magnet 46 being coupled to the drawer 44 and/or the tube support 72 without the need of fasteners. Eliminating fasteners improves the sanitation of the magnetic separator 30 and prevents fasteners from inadvertently being lost or placed into the product flow path 34. Furthermore, the elimination of fasteners improves the ease with which the at least one magnet 46 may be assembled with the drawer 44 and/or the tube support 72.

Figure 9:
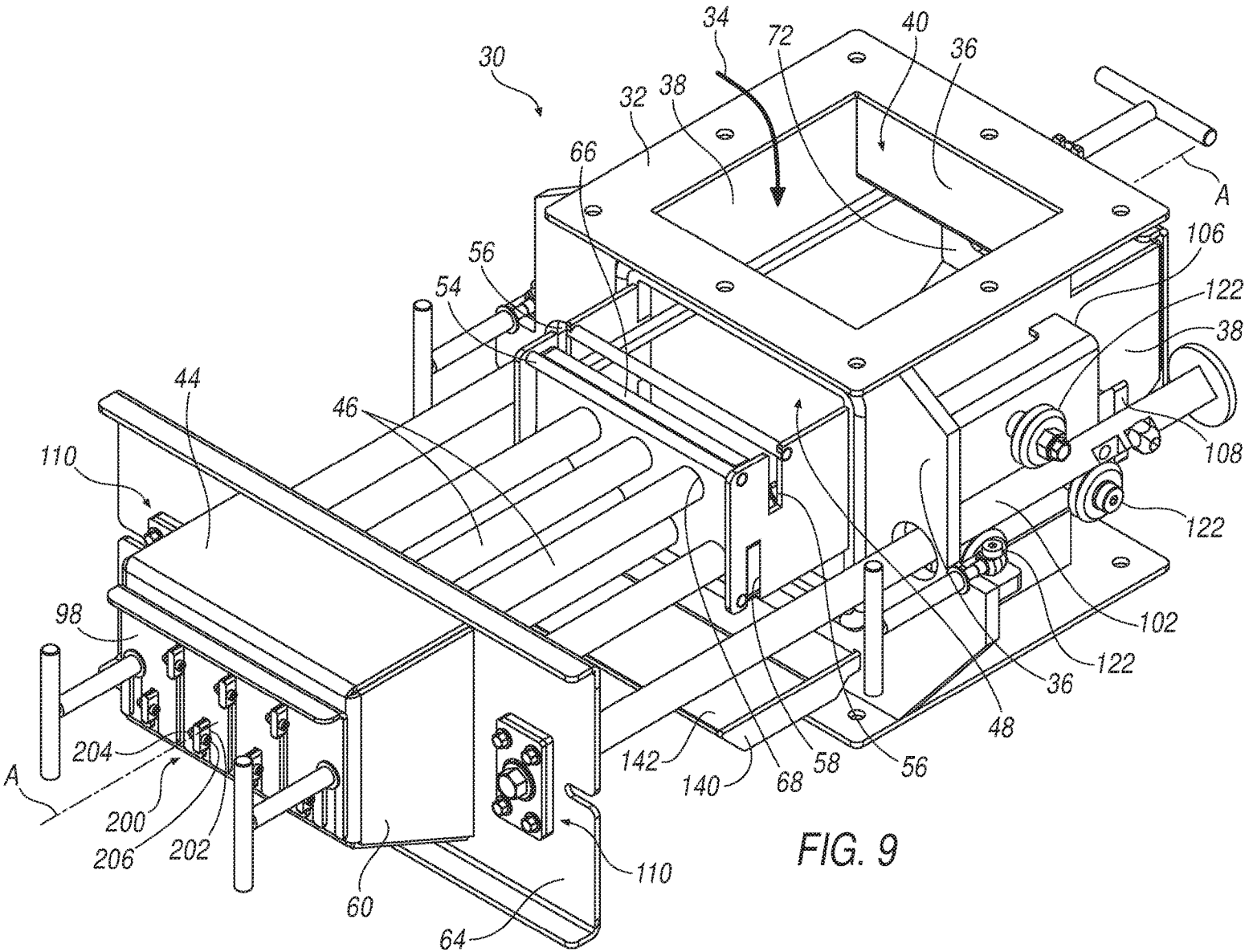
FIG. 9 is a perspective view of the drawer spaced from the housing in a third position.

The subject disclosure may also provide for the magnetic separator 30 including the housing 32 defining the product flow path 34 through which the material may pass and the drawer 44 moveable between the first position (shown in FIG. 1), the second position (shown in FIG. 2), and a third position (shown in FIG. 9). The magnetic separator 30 includes the at least one magnet 46 operatively connected to the drawer 44, with the at least one magnet 46 positioned within the product flow path 34 in the first position of the drawer 44 and with the at least one magnet 46 withdrawn from the flow path when in the second position.

The magnetic separator 30 further includes at least one guide rail 102 fixed to the drawer 44 and movably coupled to the housing 32 to support the drawer 44 relative to the housing 32, and a second position stop 104 (shown in FIGS. 1, 2, and 14) selectively mounted to the at least one guide rail 102 and engageable with the housing 32. The second position stop 104 limits movement of the drawer 44 between the first and second positions when mounted to the at least one guide rail 102. The drawer 44 is movable between the first, second, and third positions when the second position stop 104 is disconnected from the at least one guide rail 102, as shown in FIG. 9. Said differently, to move the drawer 44 to the third position, the second position stop 104 is removed.

The at least one guide rail 102 may be an elongated member extending along the axis A between a pair of ends 88, with the guide rail 102 mounted to the drawer 44 at one of the pair of ends 88. As shown in FIGS. 1, 2, and 14, the at least one guide rails 102 may be a plurality of guide rails 102. In one embodiment (shown in FIG. 1), the plurality of guide rails 102 is two guide rails 102. In another embodiment (shown in FIG. 14), the plurality of guide rails 102 is four guide rails 102. Each of the at least one guide rails 102 may be supported by the housing 32, as will be described in greater detail below.

As shown in FIGS. 1 and 14, the second position stop 104 may extend laterally from the at least one guide rail 102 to engage the housing 32. The housing 32 may be disposed between the drawer 44 and the second position stop 104 when the second position stop 104 is mounted to the at least one guide rail 102. As shown in the Figures, the second position stop 104 may have a substantially planar configuration (i.e., the second position stop 104 may be flat). The second position stop 104 may be coupled to the at least one guide rail 102 to allow the selective coupling and removal of the second position stop 104 with the at least one guide rail 102. One having skill in the art will appreciate that the second position stop 104 may be coupled to the at least one guide rail 102 in any suitable manner. The second position stop 104 may abut a rear surface 106 of the housing 32, as shown in FIG. 2. The rear surface 106 of the housing 32 may be disposed opposite the drawer aperture 48. As such, the second position stop 104 may selectively engage the rear surface 106 to retain the housing 32 between the drawer 44 and the second position stop 104.

The second position stop 104 may be a single second position stop 104 coupled to the at least one guide rail 102. Alternatively, the second position stop 104 may be a plurality of second position stops 104 when the at least one guide rail 102 is the plurality of guide rails 102 (as shown in FIG. 1), with the second positions stops individually coupled to the guide rails 102 such that the second position stops 104 collectively engage the housing 32 to define the second position. Any number of second position stops 104 may be present when the plurality of guide rails 102 is present (i.e., only one second position stop 104 may be necessary to define the second position of the drawer 44).

As shown in FIG. 2, the magnetic separator 30 may further include the stripper plates 50*a*, 50*b* fixed to the housing 32 and disposed between the housing 32 and the drawer 44, with the stripper plate having the at least one aperture 52 corresponding to and closely conforming with the at least one magnet 46 and through which the at least one magnet 46 passes as the drawer 44 is moved between the first and second positions, as described in detail above.

As shown in FIG. 9, the at least one magnet 46 may be withdrawn from the aperture 52 of the stripper plates 50*a*, 50*b* when the drawer 44 is in the third position to facilitate removal of the stripper plate. More specifically, the stripper plate may further include the first stripper plate 50*a* and the second stripper plate 50*b*, with the first and second stripper plates 50*a*, 50*b* fixed to the housing 32 and having the at least one aperture 52 corresponding to and closely conforming with the at least one magnet 46 through which the at least one magnet 46 passes as the drawer 44 is moved between the first and second positions, and with the at least magnet 46 withdrawn from the apertures 52 of the first and second stripper plates 50*a*, 50*b* in the third position to facilitate removal of the first and second stripper plates 50*a*, 50*b*. Withdrawal of the at least one magnet 46 from the stripper plates 50*a*, 50*b* may refer to the drawer 44 and the at least one magnet 46 being moved away from the housing 32 and the stripper plate a sufficient distance such that the stripper plates 50*a*, 50*b* are positioned between the at least one magnet 46 and the housing 32. When tube support 72 is present, the locking mechanism 90 configured to engage the tube support 72 is disposed in the unlocked position to facilitate removal of the locking mechanism 90 from the keyed opening 92 of the tube support 72. More specifically, when present, the tube support 72 is configured to stay within the product flow path 34 of the housing 32. Therefore, to move the drawer 44 (and the at least one magnet 46) to the third position, the at least one magnet 46 must be disconnected from the tube support 72.

Referring to FIG. 9, when drawer 44 is moved to the third position, the at least one magnet 46 may be disconnected from the tube support 72 in order to pass the at least one magnet 46 to retention plate 66, which supports each of the at least one magnets 46 at a location that frees each of the stripper plates 50*a*, 50*b* so that they may be removed from their respective areas in which they are mounted. Referring now to FIG. 16, locking mechanism 200 includes, as discussed, fastener 202 attached to shoulder 96 of each magnet 46 that prevents the magnet 46 from passing through each respective keyed opening 92, which may result from an unintended rotation of the magnet 46 during maintenance of the magnetic separator, such as during stripper plate maintenance or cleaning. Each locking mechanism 200 includes a nut 204 and bolt 206 That is, the disclosed locking mechanism 200 prevents inadvertent passage of the magnets 46 through respective slots during removal of the stripper plates 50*a*, 50*b*, ensuring that the magnets 46 remain contained in their respective apertures 68 within drawer 44 and retention plate 66, avoiding injury if any one of magnets 46 were otherwise inadvertently allowed to crash toward one another during removal or replacement of stripper plates 50*a*, 50*b*.

As such, all magnetic tubes 46 are rotated to align with their respective keyed openings in the rear tube support 72, before removing rear tube support plate 72 during stripper plate maintenance. Because an operator conducting this step is able to rotate the tubes 46 by grabbing the tube 46 instead of using the locking mechanism shoulder 90, and due to the powerful strength of the magnetic tube's repelling forces, it is possible the magnetic tube can inadvertently rotate itself resulting in the magnetic tube becoming attracted to an adjacent tube thereby causing a safety hazard, should the operator's hand be in this area. To avoid this unintended mishap, the fastener 202 now installed as an additional locking mechanism 200 and in locking mechanism 90, prevents the tube from passing through the keyed opening.

As shown in FIG. 9, the magnetic separator 30 may further include the retention plate 66 to support the at least one magnet 46, with the retention plate 66 spaced from the first and second stripper plates 50*a*, 50*b*, and with the first and second stripper plates 50*a*, 50*b* between the retention plate 66 and the housing 32, as described above. The magnetic separator 30 may further include a third position stop 108 mounted to the at least one guide rail 102 and engageable with the housing 32. The third position stop 108 may limit movement of the drawer 44 between the first, second, and third positions when the second position stop 104 is disconnected from the at least one guide rail 102. Said differently, the third position stop 108 may prevent movement of the drawer 44 and the at least one magnet 46 beyond the third position. Therefore, the stripper plates 50*a*, 50*b* may be removed from the stripper plate frame 54 with the drawer 44 and the at least one magnet 46 in the third position. As such, movement of the stripper plate to the third position may allow for easy removal and cleaning of the stripper plates 50*a*, 50*b* without complete disassembly of the drawer 44 from the housing 32. While movement of the drawer 44 and the at least one magnet 46 to the third position may remove the at least one magnet 46 from the stripper plate, the at least one magnet 46 may still be disposed within the at least one hole 68 of the retention plate 66. As such, the retention plate 66 may prevent inadvertent movement of the at least one magnet 46 transverse to the axis A (commonly a result of two magnets 46 being magnetically attracted to one another, which can injure an operator that has placed an appendage between the two magnets 46). As such, the retention plate 66 retains the orientation of the at least one magnet 46 along the axis A in the third position while the stripper plates 50*a*, 50*b* may be removed for cleaning, replacement, and the like.

As shown in the Figures, the third position stop 108 may have a substantially planar configuration (i.e., the third position stop 108 may be flat). The third position stop 108 may be coupled to the at least one guide rail 102 to allow the selective coupling and removal of the third position stop 108 with the at least one guide rail 102. One having skill in the art will appreciate that the third position stop 108 may be coupled to the at least one guide rail 102 in any suitable manner. The third position stop 108 may abut the rear surface 106 of the housing 32, as shown in FIG. 9. The rear surface 106 of the housing 32 may be disposed opposite the drawer aperture 48. As such, the third position stop 108 may selectively engage the rear surface 106 to retain the housing 32 between the drawer 44 and the third position stop 108.

The third position stop 108 may be a single third position stop 108 coupled to the at least one guide rail 102. Alternatively, the third position stop 108 may be a plurality of third position stops 108 when the at least one guide rail 102 is the plurality of guide rails 102 (as shown in FIGS. 1 and 14), with the third positions stops individually coupled to the guide rails 102 such that the third position stops 108 collectively engage the housing 32 to define the third position. Any number of third position stops 108 may be present when the plurality of guide rails 102 is present (i.e., only one third position stop 108 may be necessary to define the third position of the drawer 44).

Figure 10:
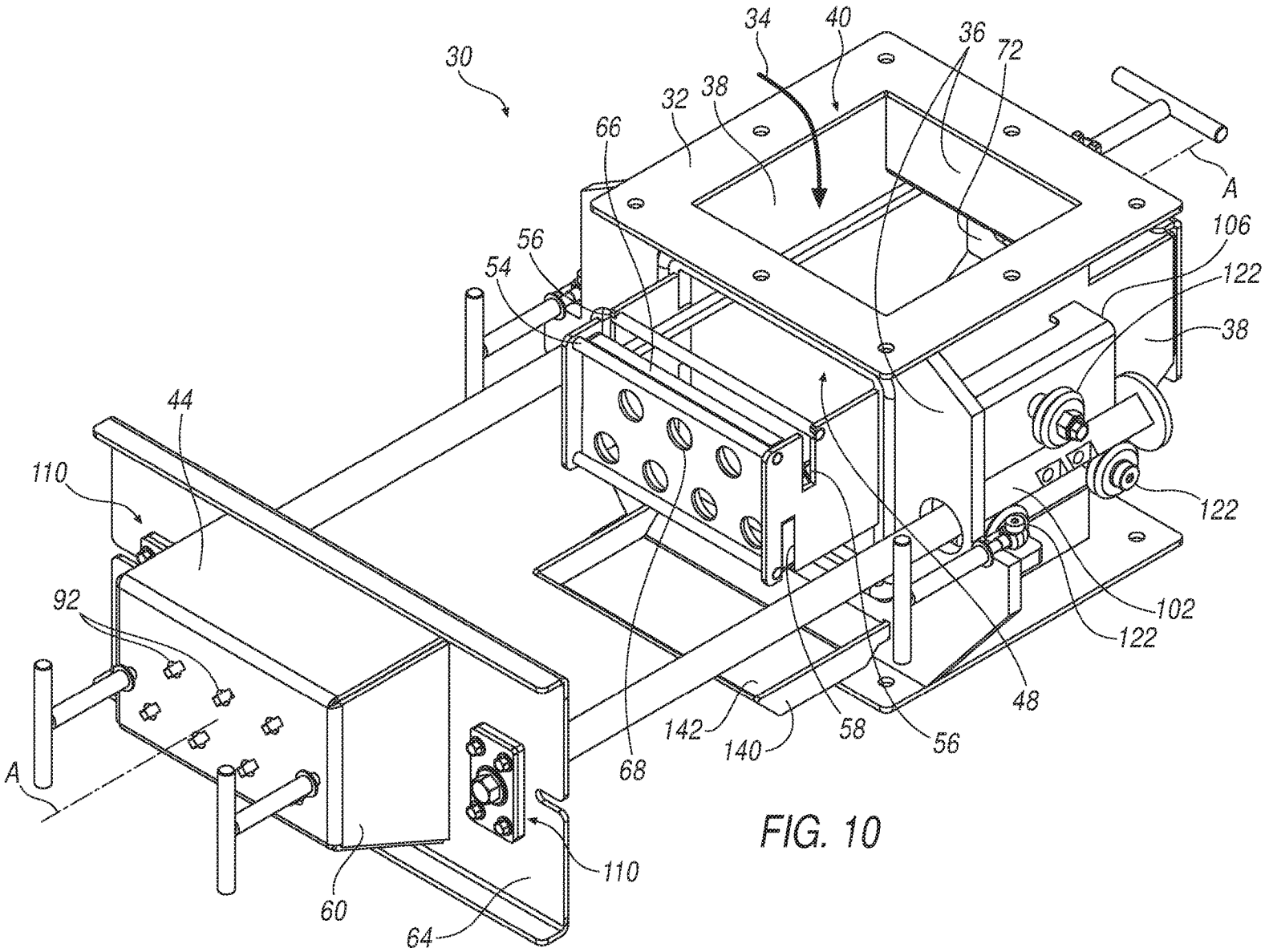
FIG. 10 is a perspective view of the drawer spaced from the housing in a fourth position.

As shown in FIG. 10, the drawer 44 may be movable to a fourth position to remove the at least one magnet 46 from the retention plate 66, with the third position stop 108 selectively mounted to the at least one guide rail 102 such that the drawer 44 is movable between the first, second, third, and fourth positions when the third position stop 108 is disconnected from the at least one guide rail 102. Removal of the at least one magnet 46 from the retention plate 66 may refer to the drawer 44 and the at least one magnet 46 being moved away from the housing 32 and the stripper plate a sufficient distance such that the retention plate 66 is positioned between the at least one magnet 46 and the housing 32. Said differently, the at least one magnet 46 may be removed from the at least one hole 68 of the retention plate 66 in the fourth position.

As such, in the fourth position, one of the pair of ends 88 of the at least one magnet 46 may be supported by the coupling of the locking mechanism 90 with the drawer 44; however, the remainder of the at least one magnet 46 extending to the other one of the pair of ends 88 may be unsupported. As such, the at least one magnet 46 may easily be removed by rotating the locking mechanism 90 that engages the drawer 44 to the unlocked position, and moving the locking mechanism 90 through the keyed opening 92. Therefore, with the drawer 44 in the fourth position, the at least one magnet 46 may be removed from the magnetic separator 30 for cleaning, replacement, and the like.

In this way, the present disclosure provides the advantage of the second position stop 104 selectively being mounted to the at least one guide rail 102, thereby allowing selective movement to the third position. Movement of the drawer 44 to the third position is desired for maintenance, but may not be desired for standard operation of the drawer 44. Therefore, the second position stop 104 allows for ease of retaining the drawer 44 within the first and second positions, while allowing the drawer 44 to move to the third position when needed for maintenance.

The subject disclosure may also provide for the magnetic separator 30 including the housing 32 defining the product flow path 34 through which the material may pass, the drawer 44 moveable between the first position and the second position (shown in FIGS. 1 and 2, respectively), and the at least one magnet 46 operatively connected to the drawer 44, with the at least one magnet 46 positioned within the product flow path 34 in the first position of the drawer 44 and with the at least one magnet 46 withdrawn from the flow path when in the second position.

Figure 11:
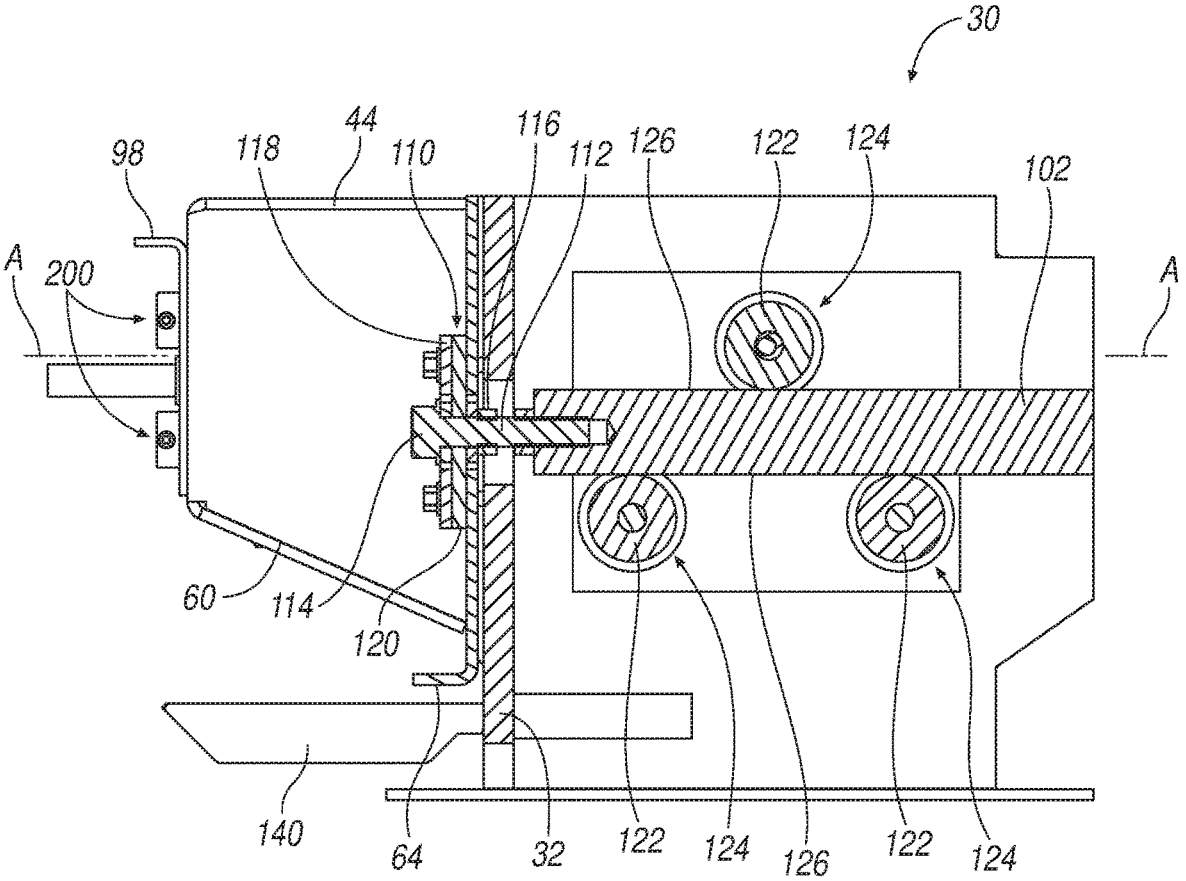
FIG. 11 is a cross-sectional view of the magnetic separator taken along 11-11 in FIG. 1, and showing a compliant fastener.

As shown in FIG. 11, the magnetic separator 30 further includes the at least one guide rail 102 movably coupled to the housing 32 and supporting the drawer 44 relative to the housing 32, and a compliant fastener 110 disposed between the at least one guide rail 102 and the drawer 44 to and fixing together the at least one guide rail 102 and the drawer 44 and facilitate engagement of the drawer 44 with the housing 32 in the first position.

The at least one guide rail 102 may include the pair of ends, as described above. The compliant fastener 110 may be disposed at one of the pair of ends of the guide rail 102. As shown in the Figures, the compliant fastener 110 is disposed at the end of the guide rail 102 that is coupled to the drawer 44 to fix together the at least one guide rail 102 and the drawer 44.

As described above, the at least one guide rail 102 may be a plurality of guide rails 102. As such, the compliant fastener 110 may be a plurality of compliant fasteners 110 (shown in FIGS. 1 and 14) individually corresponding with each of the plurality of guide rails 102 (i.e., a compliant fastener 110 is disposed between the drawer 44 and each of the guide rails 102). The compliant fastener 110 is described below in terms of one compliant fastener 110 disposed between the drawer 44 and one guide rail 102. One having skill in the art will appreciate that the description below may be applicable to any of the plurality of compliant fasteners 110 and any of the plurality of guide rails 102.

As shown in FIG. 11, the compliant fastener 110 may include a rod 112 extending from the one of the pair of ends of the guide rail 102 and which is adjustable to facilitate compliant engagement of the drawer 44 with the housing 32 in the first position. The term "compliant engagement" may refer to engagement of the drawer 44 with the housing 32 which results in the drawer 44 sealing against the housing 32 about the drawer aperture 48. As such, the position of the drawer 44 relative to the end of the guide rail 102 (moreover, the position of the drawer 44 relative to the ends of the plurality of guide rails 102) may be adjusted through the rod 112 to facilitate the drawer 44 sealing against the housing 32 about the drawer aperture 48.

The rod 112 may include a head 114 opposite the guide rail 102. Furthermore, the compliant fastener 110 may include a nut 116 disposed about the rod 112. The rod 112 may be threaded. Likewise, the nut 116 may be threaded and configured to engage the threads of the rod 112 such that rotation of the nut 116 in the clockwise and counter-clockwise directions may progressively move the nut 116 toward or away from the head 114. The drawer 44 is disposed between the head 114 and the nut 116. As such, the nut 116 may be rotated to engage and secure the drawer 44 between the nut 116 and the head 114 of the nut 116. Furthermore, the end of the guide rail 102 may be threaded and configured to engage the threads of the rod 112. As such, rotation of the rod 112 in the clockwise and counter-clockwise directions may progressively move the rod 112 into or out of the guide rail 102. Therefore, movement of the rod 112 into and out of the guide rail 102 adjusts the location of the drawer 44 relative to the housing 32 in the first position. More specifically, each of the plurality of threaded rod 112 adjusts the position of a respective portion of the drawer 44 relative to the housing 32. The plurality of rods 112 may move into and out of the plurality of guide rails 102, with each of the plurality of rods 112 independently movable into or out of the respective guide rail 102 to collectively adjust the positioning of the drawer 44 to ensure engagement of the drawer 44 with the housing 32 about the drawer aperture 48.

The compliant fastener 110 may include a backing plate 118 mounted to the rod 112 and a deformable gasket 120 disposed between the backing plate 118 and the drawer 44 to further facilitate compliant engagement of the drawer 44 with the housing 32 in the first position. More specifically, the backing plate 118 may be disposed between the head 114 and the drawer 44 and the deformable gasket 120 may be disposed between the backing plate 118 and the drawer 44. As described above, the nut 116 may move toward the head 114 to sandwich the backing plate 118, the deformable gasket 120, and the drawer 44 therebetween. The deformable gasket 120 may compress between the backing plate 118 and the drawer 44. Engagement of the drawer 44 with the housing 32 in the first position may further compress the deformable gasket 120. More specifically, if the positioning of the plurality of rods 112 relative to the plurality of the guide rails 102 may be askew, such that a portion of the drawer 44 may engage the housing 32 before the drawer 44 is disposed in the first position. Without the deformable gasket 120, the engagement of the portion of the drawer 44 with the housing 32 would stop further movement of the drawer 44 into the first position, in which drawer 44 engages the housing 32 about the drawer aperture 48. The compressibility of the deformable gasket 120 allows for continued movement of drawer 44 to the first position and engagement of the drawer 44 with the housing 32 about the drawer aperture 48. The deformable gasket 120 may be comprised of a soft durometer rubber, or any other material capable of deformation.

Figure 12:
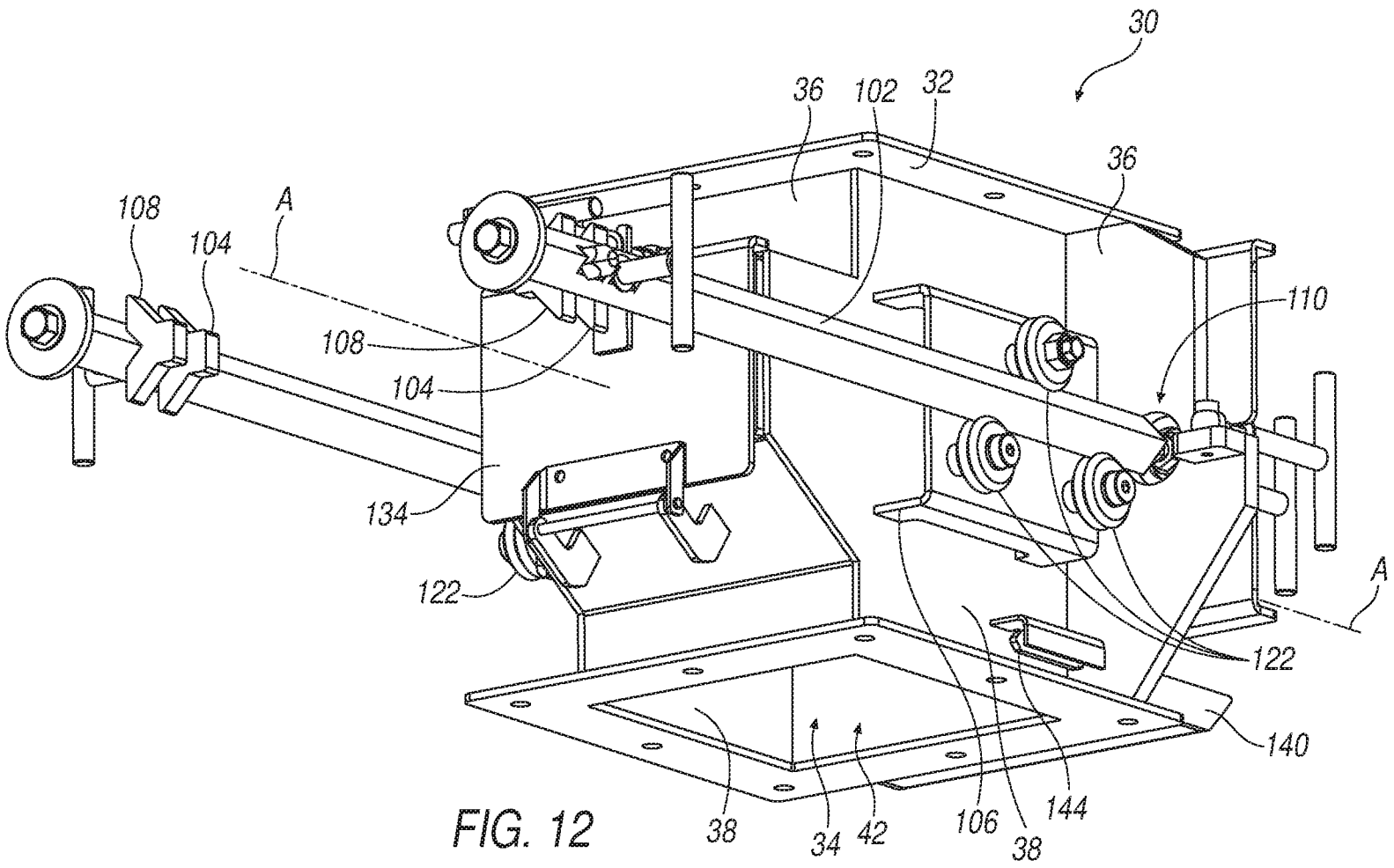
FIG. 12 is a perspective view of the magnetic separator, showing a plurality of guide rollers supporting a plurality of guide rails.

As shown in FIGS. 1, 12, and 14, the magnetic separator 30 may further include at least one guide roller 122 rotatably engaging the at least one guide rail 102 between the pair of ends to support the drawer 44 relative to the housing 32 as the drawer 44 moves between the first and second positions.

The at least one guide roller 122 may be configured to rotate about a roller axis, which may be substantially perpendicular to the axis A which the drawer 44 moves along. As shown in the Figures, the at least one guide roller 122 may be rotatably mounted to the housing 32. More specifically, the at least one guide roller 122 may be rotatably mounted to one of the side walls 38 of the housing 32 with the guide rail 102 extending along the side wall 38 and into engagement with the at least one guide roller. The at least one guide roller 122 may be a single guide roller 122 with the at least one guide rail 102 laying along the single guide roller. The single guide roller 122 may be disposed below the at least one guide rail 102 to exert an upward force against the at least one guide rail 102 opposing the force of gravity.

Alternatively, the at least one guide roller 122 may be further defined as at least a pair of guide rollers 122 both engaging the at least one guide rail 102 on opposing sides of the at least one guide rail 102 to impart opposing forces on the at least one guide rail 102 and laterally support the at least one guide rail 102. More specifically, the pair of guide rollers 122 may be disposed one opposing sides of the at least one guide roller 122 to prevent movement of the at least one guide rail 102 toward each of the pair of guide rollers 122. Said differently, the pair of guide rollers 122 may prevent upward and downward movement of the at least one guide rail 102. As shown in the Figures, the at least a pair of guide rollers 122 may be further defined as at least three guide rollers 122, with two of the guide rollers 122 disposed below the at least one guide rail 102 and one of the guide rollers 122 disposed above the at least one guide rail 102. One having skill in the art will appreciate that the at least one guide roller 122 may be any number of guide rollers 122 engaging the at least one guide rail 102.

As shown in FIG. 5, each of the at least one guide roller 122 and the at least one guide rail 102 may have corresponding V-shape configurations to support the drawer 44 relative to the housing 32 and to clean the at least one guide rail 102. More specifically, the at least one guide roller 122 may define a channel 124 having a V-shape configuration. The at least one guide rail 102 may define at least one corner 126 extending toward the at least one guide roller 122 and having a V-shape configuration that is sized to be received with the channel 124 of the at least one guide roller 122. Moreover, the at least one corner 126 may be further defined as a pair of corners 126 opposing one another with one of the pair of corners 126 engaging the channel 124 of one of the pair of guide rollers 122 and the other one of the pair of corners 126 engaging the channel 124 of one of the pair of guide rollers 122, opposite the first guide roller 122.

The V-shape configuration of the at least one guide roller 122 and the at least one guide rail 102 prevents lateral movement of the guide rail 102 toward and away from the housing 32. More specifically, the V-configuration of the corner 126 of the guide rail 102 and the channel 124 of the guide roller 122 facilitate the abutment of the guide rail 102 with the guide roller(s) 122 when the guide rail 102 moves toward or away from the housing 32. Moreover, the V-shape configuration of the at least one guide roller 122 and the at least one guide rail 102 promotes remove of materials from between the at least one guide roller 122 and the at least one guide rail 102.

As described above, the at least one guide rail 102 may be a plurality of guide rails 102. As such, the at least one guide roller 122 may be utilized with each of the plurality of guide rails 102 such that the at least one guide roller 122 may be a plurality of guide rollers 122. As such, the description above of the at least one guide roller 122 engaging the at least one guide rail 102 may be applicable to each of the guide rollers 122 engaging the plurality of guide rails 102.

In this way, the present disclosure provides the advantage of allowing compliant coupling between the drawer 44 and the at least one guide rail 102 to enable a seal between the drawer 44 and the housing 32 in the first position. This prevents material from leaking out of the product flow path 34 when the drawer 44 is in the first position.

As shown in FIG. 2, the magnetic separator 30 may further include a first seal cord 128 disposed between the drawer 44 and the housing 32. As shown in FIG. 4, the first seal cord 128 may have a substantially annular configuration (i.e., the first seal cord 128 may be one, continuous cord without ends). One having skill in the art will appreciate that the first seal cord 128 may have a discontinuous configuration such that the first seal cord 128 extends between a pair of ends.

As shown in FIG. 6, one of the drawer 44 and the housing 32 may define a first seal channel 130. In either embodiment, the first seal channel 130 surrounds the drawer aperture 48 when the drawer 44 is in the first position with the first channel opening toward the other one of the drawer 44 and the housing 32. The first seal channel 130 is shown in the Figures, for exemplary purposes, as being defined by the housing 32.

As shown in FIGS. 4 and 6, the first seal cord 128 may be disposed in the first seal channel 130 entirely about the drawer aperture 48. As shown in FIG. 6, the first seal channel 130 may have a cross-sectional shape which is quadrilateral. On the other hand, the first seal cord 128 may have a cross-sectional shape which is substantially circular. Moreover, the cross-sectional shape of the first seal cord 128 may have a width which is greater than a width of the first seal channel 130. One having skill in the art will appreciate that the first seal cord 128 and the first seal channel 130 may have any suitable cross-sectional shape and may be sized to have any suitable width.

The first seal cord 128 may be comprised of a compressible material such as a soft durometer rubber. Because the width of the first seal cord 128 may be greater than the width of the first seal channel 130, the first seal cord 128 may be compressed to insert the first seal cord 128 into the first seal channel 130. The substantially circular cross-sectional shape of the first seal cord 128 under compression within the first seal channel 130 may facilitate expansion of the first seal cord 128 into the corners of the first seal channel 130. As such, the first seal channel 130 may be coupled to the one of the drawer 44 and the housing 32 within the first seal channel 130 without the need of an adhesive. Furthermore, the first seal cord 128 may extend outside the first seal channel 130 such that the first seal cord 128 extends beyond the one of the drawer 44 and the housing 32. As such, the first seal cord 128 may engage and seal against the other one of the drawer 44 and the housing 32 in the first position.

As shown in FIG. 6, the housing 32 may further include a rear aperture 132 opposite the drawer aperture 48. The rear aperture 132 may provide access into the product flow path 34. Access through the rear aperture 132 may be advantageous for, as a non-limiting example, manipulating the tube support 72. The magnetic separator 30 may further include an access panel 134 which may engage the housing 32 about the rear aperture 132 to close the rear aperture 132, as shown in FIG. 12. The magnetic separator 30 may further include a second seal cord 136, similar in size, shape, and configuration to the first seal cord 128, as shown in FIG. 6. Likewise, one of the access panel 134 and the housing 32 may define a second seal channel 138, similar in size, shape, and configuration to the first seal channel 130. The second seal channel 138 accepts the second seal cord 136 (like the first seal channel 130 accepting the first seal cord 128) to couple second seal cord 136 to the one of the access panel 134 and the housing 32 and seal between the access panel 134 and the housing 32. One having skill in the art will appreciate that the description of the first seal cord 128 and the first seal channel 130 above may be directly applicable to the second seal cord 136 and the second seal channel 138.

Figure 13:
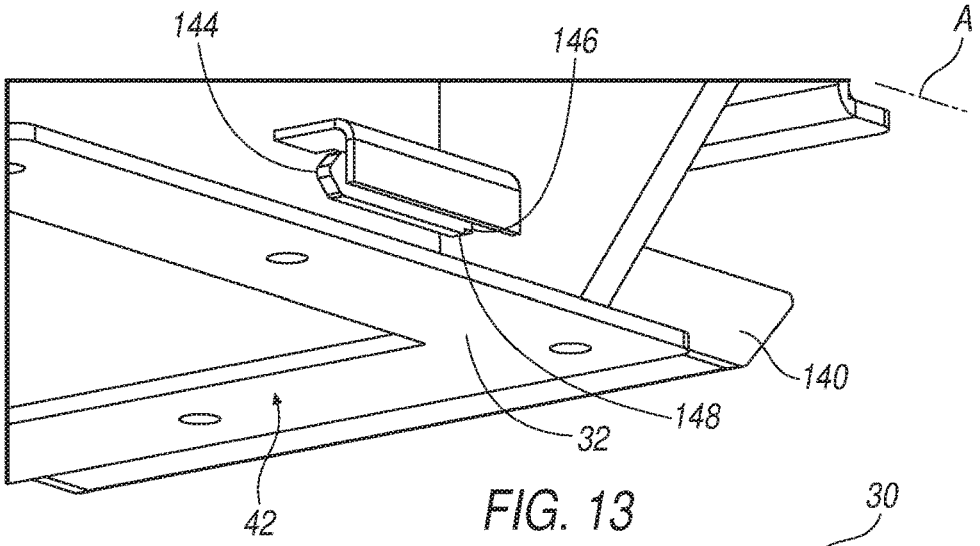
FIG. 13 is a perspective view of a portion of the magnetic separator, showing a catch tray coupled to the housing.

As shown in FIGS. 1 and 14, the magnetic separator 30 may further include a catch tray 140 positioned below the housing 32. More specifically, the catch tray 140 may be partially positioned below the housing 32 and partially positioned below the stripper plate, as shown in FIG. 2. Even more specifically, the catch tray 140 may have a basin 142 positioned under the stripper plate and a pair of arms 144 (as shown in FIG. 13) extending from the basin 142 under the housing 32. The basin 142 may be configured to catch the ferrous materials remove from the at least one magnet 46 as the at least one magnet 46 moves within the aperture 52 of the stripper plate.

As shown in FIG. 13, the pair of arms 144 may be cantilevered through engagement with the housing 32. More specifically, a top surface of each of the arms 144 engage a bottom surface of the housing 32. Furthermore, a bottom surface of the arms 144 may have a locking notch 146 for accepting a strip 148 defined by of the housing 32. The strip 148 and the bottom surface of the housing 32 may apply opposing forces on the top and bottom surfaces of the arms 144, which prevents further downward movement of the catch tray 140. The engagement of the strip 148 within the locking notch 146 of the arms 144 may prevent movement of the cantilevered collection tray toward and away from the housing 32 along the axis A of the drawer 44. The catch tray 140 may be easily removed from engagement with the housing 32 for cleaning purposes by moving the basin 142 up (to remove the strip 148 from the locking notches 146) and pulling the catch tray 140 away from the housing 32.

Movement of the drawer 44 between the first, second, third, and fourth positions may be performed by an operator manually moving the drawer 44. Alternatively, the magnetic separator 30 may include an actuator which may mechanically move the drawer 44 between the first, second, third, and fourth positions.

Thus, according to the disclosure, a method of fabricating, disassembling, cleaning, and reassembling a magnetic separator is disclosed as described above. That is, each of the operational mechanisms described above are also equally applicable to the abovementioned methods. That is each disclosed method incorporates in their entirety the corresponding descriptive operations above. For instance, in one example the above methods include affixing locking mechanism 200, using fastener 202 to include nut 204 and bolt 206, which prevents shoulder 96 from passing through a respective keyed opening 92. The disclosed methods include removing second position stops 104, and retracting or opening drawer 44 toward the third position, as depicted in FIG. 9. The methods include removing anti-rotation mechanism 98, if present, and rotating each of magnets 46 in order that rear tube support plate 72 may be removed by aligning shoulders 96 of each magnet 46 with respective keyed opening 92 within rear tube support plate 72. The methods further include further opening or retracting or opening drawer 44 to the third position, such that magnets 46 are retracted sufficiently far to be axially clear of one or both of stripper plates 50*a*, 50*b*. Each of magnets 46 is thereby supported on one end by holes 68 within retention plate 66, and on the other end by shoulders 96 within keyed openings 92 of drawer 44. Accordingly, although each magnet 46 may be rotatable about its axis when in the third position, each magnet 46 is nevertheless contained axially by locking mechanism 200. That is, locking mechanism 200 prevents each magnet 46 from freeing axially, providing a support between retention plate 66 and drawer 44 during maintenance of the stripper plates 50*a*, 50*b*.

According to one aspect, a magnetic separator includes a housing defining a product flow path through which material may pass, a drawer moveable between a first position and a second position, at least one magnet operatively connected to said drawer, with said at least one magnet positioned within said product flow path in said first position of said drawer and with said at least one magnet withdrawn from said flow path when in said second position, and a stripper plate fixed to said housing and disposed between said housing and said drawer, said stripper plate having at least one aperture corresponding to and closely conforming with said at least one magnet and through which said at least one magnet passes as said drawer is moved between said first and second positions. The stripper plate is spaced a predetermined distance from said housing to define a gap therebetween, with said at least one aperture of said stripper plate serving to strip material which has been attracted to said at least one magnet off of said at least one magnet in said gap as said drawer is moved from said first position to said second position and said at least one magnet is withdrawn from said product flow path.

According to another aspect, a magnetic: separator includes a housing defining a product flow path through which material may pass and having a pair of diverters opposing one another and extending into said product flow path. The magnetic separator includes a drawer moveable between a first position and a second position, at least one magnet operatively connected to said drawer, with said at least one magnet positioned within said product flow path in said first position of said drawer and with said at least one magnet withdrawn from said flow path when in said second position, and a tube support disposed within said product flow path, with said at least one magnet operatively connected to said tube support, and with said tube support having a pair of slots corresponding to and adapted to receive said pair of diverters therein such that said pair of diverters guide said movement of said tube support, said at least one magnet, and said drawer between said first and second positions.

According to another aspect, a magnetic separator includes a housing defining a product flow path through which material may pass, a drawer moveable between a first position and a second position, and a tube support disposed within said product flow path. The magnetic separator includes at least one magnet extending between a pair of ends and operatively connected to each of said drawer and said tube support, with said at least one magnet positioned within said product flow path in said first position of said drawer and with said at least one magnet withdrawn from said flow path when in said second position, and a locking mechanism extending from at least one of said pair of ends. At least one of said drawer and said tube support defines at least one keyed opening corresponding to and adapted to accept said locking mechanism of said at least one magnet, with said locking mechanism rotatable between an unlocked position, in which said locking mechanism may freely move into and out of said keyed opening, and a locked position, in which said locking mechanism is retained in said keyed opening.

According to yet another aspect, a magnetic separator includes a housing defining a product flow path through which material may pass, a drawer moveable between a first position, a second position, and a third position, and at least one magnet operatively connected to said drawer, with said at least one magnet positioned within said product flow path in said first position of said drawer and with said at least one magnet withdrawn from said flow path when in said second position. The magnetic separator includes at least one guide rail fixed to said drawer and movably coupled to said housing to support said drawer relative to said housing, and a second position stop selectively mounted to said at least one guide rail and engageable with said housing, with said second position stop limiting movement of said drawer between said first and second positions when mounted to said at least one guide rail and with said drawer movable between said first, second, and third positions when said second position stop is disconnected from said at least one guide rail.

According to still another aspect, a magnetic separator includes a housing defining a product flow path through which material may pass, a drawer moveable between a first position and a second position, and at least one magnet operatively connected to said drawer, with said at least one magnet positioned within said product flow path in said first position of said drawer and with said at least one magnet withdrawn from said flow path when in said second position. The magnetic separator includes at least one guide rail movably coupled to said housing and supporting said drawer relative to said housing, and a compliant fastener disposed between said at least one guide rail and said drawer to and fixing together said at least one guide rail and said drawer and facilitate engagement of said drawer with said housing in said first position.

As such, disclosed is a magnetic separator apparatus and methods of fabricating, disassembling, cleaning, and reassembling same.

According to one example, the magnetic separator includes a housing defining a product flow path, a drawer moveable between a first position and a second position, and a magnet operatively connected to the drawer, the magnet positioned within the product flow path when in the first position and the magnet withdrawn from the flow path when in the second position. A stripper plate frame is attached to the housing, and a stripper plate is fixed to the stripper plate frame that conforms with the magnet and through which the magnet passes as the drawer is moved between the first and second positions. An anti-rotation mechanism having a slot that engages along a length of a shoulder such that, when the anti-rotation mechanism is positioned having the slot over the shoulder, the magnet is prevented from moving from the axially locked position. The shoulder extends beyond an outer surface of the anti-rotation mechanism.

The drawer includes a keyed opening and the magnet includes the shoulder that passes through the keyed opening, such that when the shoulder is in position and rotated with respect to the keyed opening, the magnet is axially locked with respect to the drawer. The shoulder includes a hole passing therethrough, and the hole is positioned beyond the outer surface of the anti-rotation mechanism. A fastener passing through the hole. The fastener is engaged against the outer surface of the anti-rotation mechanism and includes a bolt passing through the hole, and a nut attached to the bolt which fastens the bolt to the shoulder. The aperture serves to strip material attracted to the magnet off of the magnet as the drawer is moved from the first position to the second position. The stripper plate is fully enclosed within the drawer when the drawer is in the first position and sealed against the housing, to prevent flow of product out of the product flow path and through the drawer. The stripper plate frame includes a first pair of notches and the first stripper plate is fixed to the stripper plate frame when positioned within the first pair of notches, and a second stripper plate positioned between the first stripper plate and the stripper plate frame, the second stripper plate having a second aperture through which the magnet passes as the drawer is moved between the first and second positions. The second aperture has a tolerance fit such that a diameter of the second aperture is smaller than an outer diameter of the magnet, resulting in an interference fit. The stripper plate frame includes a second pair of notches that extend in a direction opposite that of the first pair of notches, such that the retention plate is coupled to the stripper plate frame via the second pair of notches.

The disclosed methods of fabricating, disassembling, cleaning, and reassembling the magnetic separator include providing a housing that defines a flow path and a magnet positioned within the flow path, the magnet having a shoulder, and affixing a stripper plate to a stripper plate frame of the magnetic separator, wherein the stripper plate conforms with the magnet such that the magnet passes through the stripper plate as the drawer is moved between first and second positions. The methods further include positioning an anti-rotation mechanism over the shoulder such that, when the anti-rotation mechanism is positioned having a slot over the shoulder, the magnet is prevented from moving from the axially locked position. The shoulder extends beyond an outer surface of the anti-rotation mechanism.

The methods further include passing the shoulder of the magnet through a keyed opening of the drawer, and rotating the shoulder with respect to the keyed opening to axially lock the magnet with respect to the drawer. Positioning the anti-rotation mechanism further includes positioning the anti-rotation mechanism to engage along a length of the shoulder such that, when the anti-rotation mechanism is positioned having the slot over the shoulder, the magnet is prevented from moving from the axially locked position. Positioning the anti-rotation mechanism further includes positioning the anti-rotation mechanism such that a hole in the shoulder passes therethrough, the hole positioned beyond the outer surface of the anti-rotation mechanism, passing a fastener through the hole, and engaging the fastener against the outer surface of the anti-rotation mechanism. The methods further include passing the bolt through the hole and attaching a nut to the bolt. The methods further include moving the drawer from the first position to the second position, such that the aperture strips material off of the magnet as the drawer is moved from the first position to the second position.

The disclosed subject matter has been described in an illustrative manner. It is to be understood that the terminology which has been used is intended to be in the nature of words of description rather than of limitation. Many modifications and variations of the disclosed subject matter are possible in light of the above teachings. Therefore, within the scope of the appended claims, the disclosed subject matter may be practiced other than as specifically described.

What is claimed is:

1. A magnetic separator comprising:

a housing defining a product flow path;

a drawer moveable between a first position and a second position;

a magnet operatively connected to the drawer, the magnet positioned within the product flow path when in the first position and the magnet withdrawn from the flow path when in the second position;

a stripper plate frame coupled to the housing;

a first stripper plate, contained within the stripper plate frame, having an aperture through which the magnet passes as the drawer is moved between the first and second positions; and an anti-rotation mechanism having a slot that engages along a length of a shoulder such that, when the anti-rotation mechanism is positioned having the slot over the shoulder, the magnet is prevented from moving from an axially locked position;

wherein the shoulder extends beyond an outer surface of the anti-rotation mechanism;

wherein the stripper plate frame includes a first pair of notches and the first stripper plate is fixed to the stripper plate frame when positioned within the first pair of notches.

2. The magnetic separator of claim 1, wherein the drawer includes a keyed opening and the magnet includes the shoulder that passes through the keyed opening, such that when the shoulder is in position and rotated with respect to the keyed opening, the magnet is axially locked with respect to the drawer.

3. The magnetic separator of claim 1, wherein the shoulder includes a hole passing therethrough, and the hole is positioned beyond the outer surface of the anti-rotation mechanism.

4. The magnetic separator of claim 3, further comprising a fastener passing through the hole.

5. The magnetic separator of claim 4, wherein the fastener is engaged against the outer surface of the anti-rotation mechanism.

6. The magnetic separator of claim 5, wherein the fastener includes a bolt passing through the hole, and a nut attached to the bolt, which fastens the bolt to the shoulder.

7. The magnetic separator of claim 1, wherein the aperture serves to strip material attracted to the magnet off of the magnet as the drawer is moved from the first position to the second position.

8. The magnetic separator of claim 1, wherein the first stripper plate is fully enclosed within the drawer when the drawer is in the first position and sealed against the housing, to prevent flow of product out of the product flow path and through the drawer.

9. The magnetic separator of claim 1, further comprising a second stripper plate positioned within the stripper plate frame, the second stripper plate conforming with the magnet and having a second aperture through which the magnet passes as the drawer is moved between the first and second positions.

10. The magnetic separator of claim 9, wherein the second aperture has a tolerance fit such that a diameter of the second aperture is smaller than an outer diameter of the magnet, resulting in an interference fit.

11. The magnetic separator of claim 10, wherein the stripper plate frame includes a second pair of notches that extend in a direction opposite that of the first pair of notches, such that the retention plate is coupled to the stripper plate frame via the second pair of notches.

12. A method of operating a magnetic separator, comprising:

providing a housing that defines a flow path and a magnet positioned within the flow path, the magnet having a shoulder;

affixing a stripper plate within a stripper plate frame of the magnetic separator, wherein the stripper plate having an aperture that conforms with the magnet such that the magnet passes through the aperture as a drawer is moved between first and second positions;

positioning an anti-rotation mechanism over the shoulder such that, when the anti-rotation mechanism is positioned having a slot over the shoulder, the magnet is prevented from moving from the axially locked position;

wherein the shoulder extends beyond an outer surface of the anti-rotation mechanism;

further comprising passing the shoulder of the magnet through a keyed opening of the drawer, and rotating the shoulder with respect to the keyed opening to axially lock the magnet with respect to the drawer;

wherein positioning the anti-rotation mechanism further comprises positioning the anti-rotation mechanism to engage along a length of the shoulder such that, when the anti-rotation mechanism is positioned having the slot over the shoulder, the magnet is prevented from moving from the axially locked position;

wherein positioning the anti-rotation mechanism further comprises positioning the anti-rotation mechanism such that a hole in the shoulder passes therethrough, the hole positioned beyond the outer surface of the anti-rotation mechanism;

further comprising passing a fastener through the hole; and engaging the fastener against the outer surface of the anti-rotation mechanism;

wherein the fastener is a bolt, further comprising passing the bolt through the hole and attaching a nut to the bolt.

13. The method of claim 12, further comprising moving the drawer from the first position to the second position, such that the aperture strips material off of the magnet as the drawer is moved from the first position to the second position.

14. A magnetic separator comprising:

a housing defining a product flow path;

a drawer moveable between a first position and a second position;

a magnet operatively connected to the drawer, the magnet positioned within the product flow path when in the first position and the magnet withdrawn from the flow path when in the second position;

a stripper plate frame coupled to the housing;

a first stripper plate, contained within the stripper plate frame, having an aperture through which the magnet passes as the drawer is moved between the first and second positions; and an anti-rotation mechanism having a slot that engages along a length of a shoulder such that, when the anti-rotation mechanism is positioned having the slot over the shoulder, the magnet is prevented from moving from an axially locked position;

wherein the shoulder extends beyond an outer surface of the anti-rotation mechanism;

wherein the shoulder includes a hole passing therethrough, and the hole is positioned beyond the outer surface of the anti-rotation mechanism;

further comprising a fastener passing through the hole, wherein the fastener is engaged against the outer surface of the anti-rotation mechanism, and wherein the fastener includes a bolt passing through the hole, and a nut attached to the bolt, which fastens the bolt to the shoulder.

* * * * *